US009383135B2

(12) United States Patent
Park et al.

(10) Patent No.: US 9,383,135 B2
(45) Date of Patent: Jul. 5, 2016

(54) REFRIGERATOR

(75) Inventors: Sung Cheul Park, Gwangsan-gu (KR); Jae Sek Oh, MaBuk-Gu (KR); Sang Gyu Jung, Gwangju-si (KR); Mu Yeol Sun, Gwangsan-gu (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 13/137,372

(22) Filed: Aug. 9, 2011

(65) Prior Publication Data

US 2012/0038258 A1 Feb. 16, 2012

(30) Foreign Application Priority Data

Aug. 11, 2010 (KR) ..... 10-2010-0077593

(51) Int. Cl.
*F25D 25/02* (2006.01)
*E05D 7/00* (2006.01)
(Continued)

(52) U.S. Cl.
CPC ..... *F25D 25/028* (2013.01); *E05D 7/0027* (2013.01); *E05D 7/0423* (2013.01); *E05D 7/081* (2013.01); *E05D 2007/0469* (2013.01); *E05D 2007/0484* (2013.01); *E05Y 2201/22* (2013.01); *E05Y 2201/244* (2013.01); *E05Y 2600/524* (2013.01); *E05Y 2600/53* (2013.01);
(Continued)

(58) Field of Classification Search
CPC ..... E05D 7/0027; E05D 7/081; E05D 7/0423; E05D 2007/0469; E05D 2007/0484; F25D 25/028; F25D 2323/024; F25D 2400/32; E05Y 2201/22; E05Y 2201/244; E05Y 2600/524; E05Y 2600/53; E05Y 2600/60; E05Y 2900/31; E05Y 2800/71
USPC ..... 312/401, 404, 405, 405.1, 204, 292, 312/326, 329, 109; 16/258, 259, 382, 241, 16/243, 244, 245, 268
See application file for complete search history.

(56) References Cited

U.S. PATENT DOCUMENTS 4,170,391 A * 10/1979 Bottger ..... 312/405
4,586,348 A * 5/1986 Nakayama et al. ..... 62/277
(Continued)

FOREIGN PATENT DOCUMENTS

CN 101398248 4/2009
JP 58-110792 7/1983
(Continued)

OTHER PUBLICATIONS

Machine Translation of WO2009043696A1.*
(Continued)

*Primary Examiner* — Andrew Roersma
(74) *Attorney, Agent, or Firm* — Staas & Halsey LLP

(57) ABSTRACT

A refrigerator including a main body provided with storage chambers, doors to open and close the storage chambers, upper hinge modules to enable one side of the upper end of each door to be rotatably installed on the main body. Main body hinge receipt parts are depressed on the upper surface of the main body to embed rear ends of the upper hinge modules in the upper surface of the main body and door hinge receipt parts are depressed on the rear surfaces of the doors to receive front ends of the upper hinge modules, and thus the main body is located at a height corresponding to the height of the doors, thereby allowing the main body provided with the storage chambers having a wider volume to be used in the refrigerator having a designated height.

12 Claims, 25 Drawing Sheets

(51) Int. Cl.

| | |
|---|---|
| ***E05D 7/04*** | (2006.01) |
| ***E05D 7/08*** | (2006.01) |
| ***E05D 7/081*** | (2006.01) |

(52) U.S. Cl.

CPC ..... *E05Y2600/60* (2013.01); *E05Y 2800/71* (2013.01); *E05Y 2900/31* (2013.01); *F25D 2323/024* (2013.01); *F25D 2400/32* (2013.01)

(56) References Cited

U.S. PATENT DOCUMENTS

| | | | | | |
|---|---|---|---|---|---|
| 4,836,626 | A * | 6/1989 | Taylor et al. | ..... | 312/257.1 |
| 4,932,729 | A * | 6/1990 | Thompson et al. | ..... | 312/405 |
| 5,215,367 | A * | 6/1993 | Montuoro et al. | ..... | 312/401 |
| 5,265,954 | A * | 11/1993 | Keil | ..... | 312/405 |
| 6,128,807 | A * | 10/2000 | Lim et al. | ..... | 16/266 |
| 6,145,336 | A * | 11/2000 | Miller et al. | ..... | 62/298 |
| 6,773,082 | B2 * | 8/2004 | Lee | ..... | 312/401 |
| 7,194,792 | B2 * | 3/2007 | Grace et al. | ..... | 29/434 |
| 7,549,300 | B2 * | 6/2009 | Chun et al. | ..... | 62/419 |
| 2004/0178707 | A1 * | 9/2004 | Avendano et al. | ..... | 312/401 |
| 2005/0006997 | A1 * | 1/2005 | Yoshioka | ..... | 312/405 |
| 2006/0244351 | A1 * | 11/2006 | Moon et al. | ..... | 312/405 |
| 2008/0284179 | A1 * | 11/2008 | Gerner et al. | ..... | 292/13 |
| 2009/0026162 | A1 * | 1/2009 | Kwon | ..... | 211/144 |
| 2009/0038117 | A1 * | 2/2009 | Moon | ..... | 16/240 |
| 2009/0261703 | A1 * | 10/2009 | Kentner et al. | ..... | 312/405 |
| 2010/0033067 | A1 * | 2/2010 | Kim et al. | ..... | 312/236 |
| 2010/0219732 | A1 * | 9/2010 | Gorz et al. | ..... | 312/405 |
| 2012/0032572 | A1 * | 2/2012 | Lee | ..... | 312/405 |

FOREIGN PATENT DOCUMENTS

| | | | | | |
|---|---|---|---|---|---|
| JP | 8-233445 | | 9/1996 | | |
| JP | 2000-97554 | | 4/2000 | | |
| JP | 2004293913 | A * | 10/2004 | ..... | F25D 23/02 |
| JP | 2007003182 | A * | 1/2007 | ..... | F25D 19/00 |
| KR | 20-0309593 | * | 4/2003 | ..... | F25D 23/02 |
| KR | 10-0750254 | | 8/2007 | | |
| WO | WO2007062909 | A1 * | 6/2007 | ..... | F25D 23/08 |
| WO | WO 2008075810 | A1 * | 6/2008 | ..... | F25D 23/02 |
| WO | 2009/043696 | A1 | 4/2009 | | |
| WO | WO 2009043696 | A1 * | 4/2009 | ..... | F25D 23/02 |
| WO | WO 2009123416 | A1 * | 10/2009 | ..... | F25D 23/02 |

OTHER PUBLICATIONS

JP 58-110792 U Translation.pdf.*

European Search Report dated Dec. 17, 2014 in corresponding European Patent Application 11177182.0.

Chinese Office Action issued Nov. 25, 2014 in corresponding Chinese Patent Application No. 201110234938.6.

* cited by examiner

REFRIGERATOR

CROSS-REFERENCE TO RELATED APPLICATION

This application claims the benefit of Korean Patent Application No. 2010-0077593, filed on Aug. 11, 2010 in the Korean Intellectual Property Office, the disclosure of which is incorporated herein by reference.

BACKGROUND

1. Field

Embodiments of the present invention relate to a refrigerator having doors to open and close storage chambers provided in a main body.

2. Description of the Related Art

In general, refrigerators are apparatuses which are provided with components of a refrigerating cycle to store articles received therein in a frozen or refrigerated state using cool air generated by an evaporator of the refrigerating cycle.

A refrigerator includes a main body provided with storage chambers to store articles, such as food, and doors to open and close the storage chambers. Each door is installed such that one side end thereof is rotatably connected to one side of the main body and is rotated in the rightward and leftward directions to open and close each storage chamber.

Recently, among refrigerators, a refrigerator, in which an opening is provided on a door and a sub-door to open and close the opening is installed at the opening so as to allow articles within a storage chamber to be taken out of the storage chamber without opening the door, has been developed and placed on the market.

SUMMARY

Therefore, it is an aspect of the present invention to provide a refrigerator which prevents lowering of the quality of an external appearance of the refrigerator due to upper hinge modules.

Additional aspects of the invention will be set forth in part in the description which follows and, in part, will be obvious from the description, or may be learned by practice of the invention.

In accordance with one aspect of the present invention, a refrigerator includes a main body provided with storage chambers, doors to open and close the storage chambers, upper hinge modules to enable one side of the upper end of each door to be rotatably installed on the main body, main body hinge receipt parts depressed on the upper surface of the main body to embed rear ends of the upper hinge modules in the upper surface of the main body, and door hinge receipt parts depressed on the rear surfaces of the doors to receive front ends of the upper hinge modules.

The upper surface of the main body may be located at a height corresponding to that of the upper ends of the doors.

The upper surfaces of the upper hinge modules may be located at a height corresponding to the upper surface of the main body.

The main body may include an outer case forming an external appearance of the main body and an inner case disposed at the inside of the outer case and forming the storage chambers, the outer case may include a main frame forming a lower surface and both side surfaces of the main body and upper frames installed at the upper end of the main frame, and the main body hinge receipt parts may be provided on the upper frames.

The upper frames may include a first upper frame disposed at the front portion of the upper surface of the main frame and provided with the main body hinge receipt parts.

The upper frames may further include a second upper frame disposed at the rear of the first upper frame in parallel with the first upper frame so as to form the upper surface of the outer case together with the first upper frame.

The first upper frame may be made of resin.

The refrigerator may further include an upper reinforcing frame made of metal and disposed under the first upper frame, and both sides of the upper reinforcing frame may be bent downward so as to correspond to the main body hinge receipt parts.

Each upper hinge module may include an upper hinge bracket provided with a front end protruded forward from the main body and an upper hinge rotatably supporting the upper end of each door, a fixing bracket fixed to the inside of each main body hinge receipt part and fixing the rear end of the upper hinge bracket, a fixing lever rotatably installed on the fixing bracket to selectively apply pressure to the upper hinge bracket to be supported by the fixing bracket according to a rotation angle of the fixing lever, and a hinge cover having a height corresponding to the depth of the main body hinge receipt parts to cover the upper hinge bracket, the fixing bracket, and the fixing lever.

The refrigerator may further include movement preventing members, each of which is disposed between each upper hinge bracket and the upper surface of each door to prevent movement of each door during transportation.

Each movement preventing member may include a pair of hinge support parts respectively formed in an arc shape and supported by both sides of the upper hinge, an elastic part formed in an arc shape and connecting one end of each of the two hinge support parts to each other to allow the two hinge support parts to be elastically supported by both sides of the upper hinge, and insertion guides, each of which is provided at the other end of each of the two hinge support parts, to guide the upper hinge so as to be inserted into a space between the two hinge supports.

In accordance with another aspect of the present invention, a refrigerator includes a main body horizontally divided into a freezing chamber and a refrigerating chamber, a freezing chamber door and a refrigerating chamber door to open and close the freezing chamber and the refrigerating chamber, respectively, and a pair of upper hinge modules to enable one side of the upper end of each of the freezing chamber door and the refrigerating chamber door to be rotatably installed on the main body, wherein a pair of main body hinge receipt parts is depressed at both sides of the upper surface of the main body to embed rear ends of the pair of upper hinge modules in the upper surface of the main body, and a pair of door hinge receipt parts is depressed on the rear surfaces of the freezing chamber door and the refrigerating chamber door to receive front ends of the pair of upper hinge modules.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
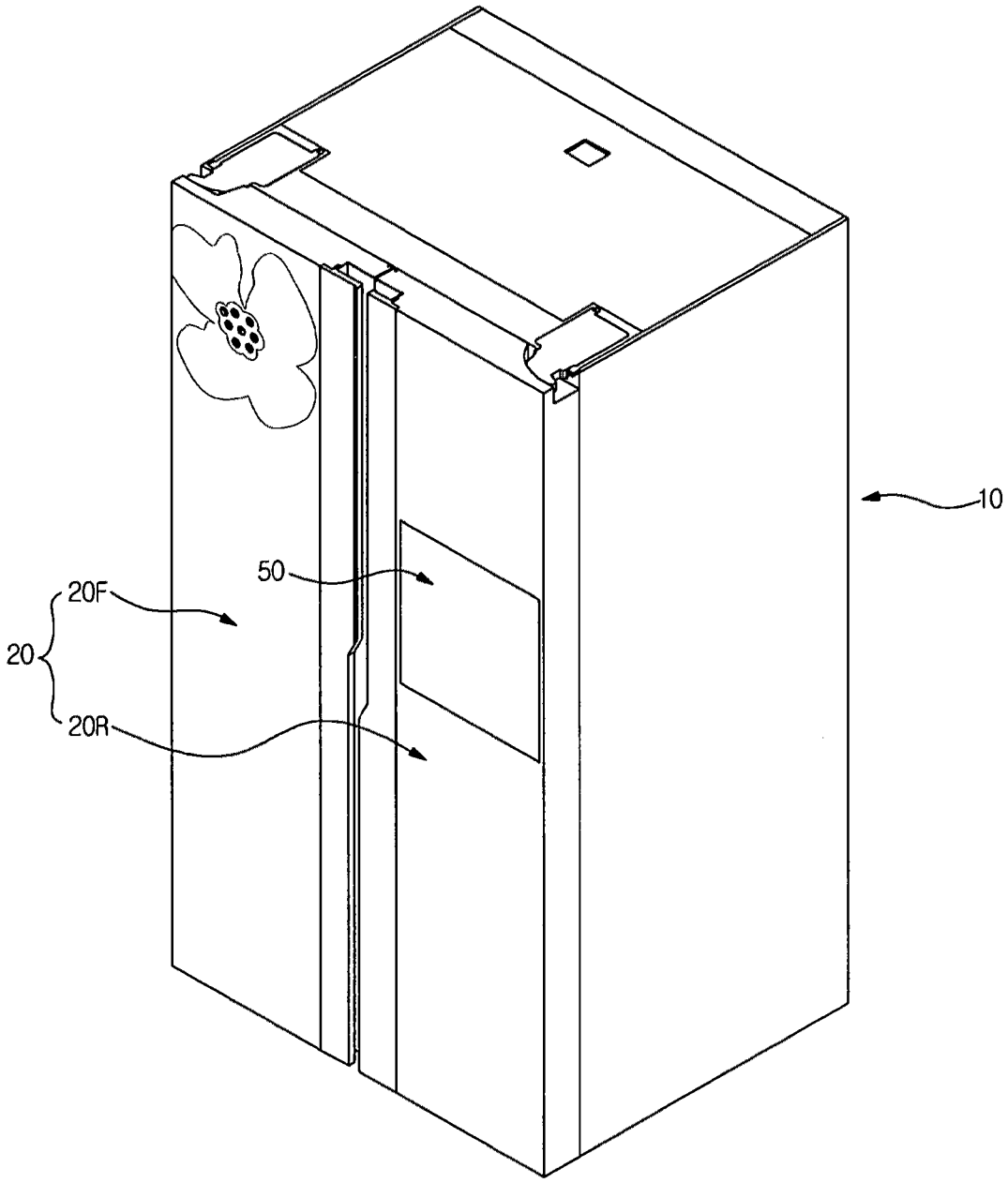
FIG. 1 is a perspective view of a refrigerator in accordance with one embodiment of the present invention.

Reference will now be made in detail to the embodiments of the present invention, examples of which are illustrated in the accompanying drawings, wherein like reference numerals refer to like elements throughout.

Hereinafter, a refrigerator in accordance with one embodiment of the present invention will be described in detail with reference to the accompanying drawings.

Figure 2:
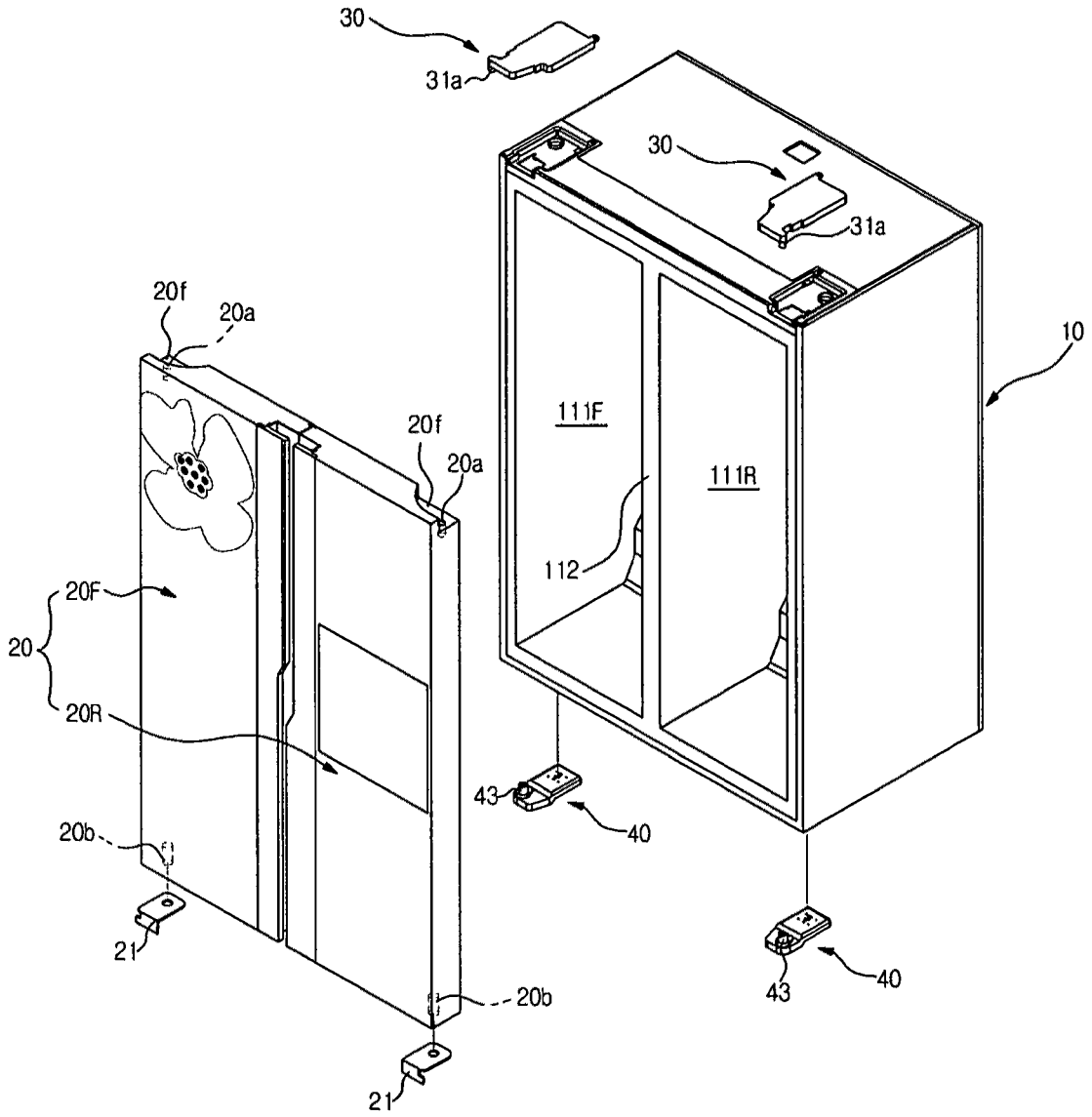
FIG. 2 is an exploded perspective view of the refrigerator in accordance with the embodiment of the present invention.

As shown in FIGS. 1 and 2, the refrigerator in accordance with this embodiment includes a main body 10 forming an external appearance of the refrigerator and provided with storage chambers 111F and 111R to store articles therein, and doors 20, each of which is provided with one side end rotatably installed on the main body 10, rotated to open and close the storage chambers 111F and 111R.

Figure 8:
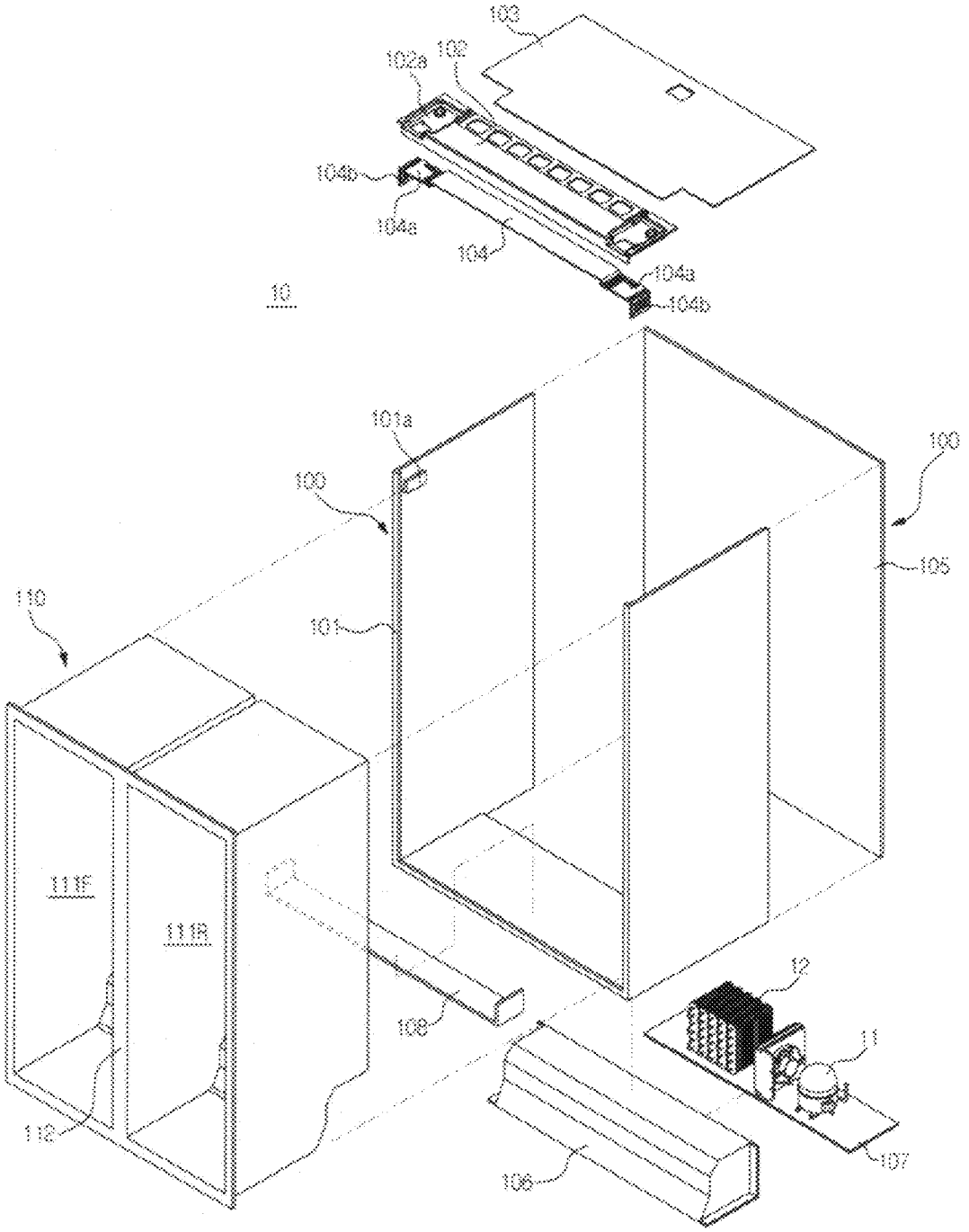
FIG. 8 is an exploded perspective view of a main body applied to the refrigerator in accordance with the embodiment of the present invention.

As shown in FIG. 8, components of a refrigerating cycle, such as a compressor 11 to compress a refrigerant, a condenser 12 to exchange heat between the refrigerant and air at the outside of the main body 10 to cool the refrigerant, an expansion valve (not shown) to decompress and expand the refrigerant, and an evaporator (not shown) to absorb heat from air at the insides of the storage chambers 111F and 111R to generate cool air, are installed in the main body 10. Thereby, the cool air generated by the evaporator is supplied to the storage chambers 111F and 111R, thereby storing the articles in a low temperature state in the storage chambers 111F and 111R.

A machinery room in which the compressor 11, the condenser 12, and the expansion valve are installed is provided at the rear region of the lower portion of the main body 10, and a cooling room in which the evaporator is disposed is installed at the rear of the storage chambers 111F and 111R.

The storage chambers 111F and 111R include a freezing chamber 111F located at one side of the main body 10 to store articles in a frozen state and a refrigerating chamber 111R located at the other side of the main body 10 to store articles in a refrigerated state, and the freezing chamber 111F and the refrigerating chamber 111R are horizontally divided from each other. The doors 20 include a freezing chamber door 20F to open and close the freezing chamber 111F and a refrigerating chamber door 20R to open and close the refrigerating chamber 111R.

The main body 10 includes an outer case 100 forming an external shape thereof, and an inner case 110 disposed in the outer case 100 to form the above-described storage chambers 111F and 111R. A space between the outer case 100 and the inner case 110 is filled with a heat insulating member. The majority of the outer case 100 is made of metal in consideration of durability, and the inner case 110 is made of resin in consideration of a heat insulating function and convenience in manufacture.

The outer case 100 forming the external shape of the main body 10 includes a main frame 101 obtained by bending a plate member made of metal in a U shape to integrally form lower and both side surfaces of the outer case 100, upper frames 102 and 103 installed at the upper end of the main frame 101 to form an upper surface of the outer case 100, a rear frame 105 covering the rear portion of the main frame 101 to form a rear surface of the outer case 100, and a machinery room frame 106 and a lower frame 107 installed at the rear region of the lower portion of the main frame 101 to respectively form the above-described machinery room and the lower surface of the machinery room.

The inner case 110 is made of resin, and is provided with an opened front surface portion to form the storage chambers 111F and 111R. A diaphragm 112 vertically extended to horizontally divide the inner case 110 into the storage chambers 111F and 111R is provided in the inner case 110, and one of the storage chambers 111F and 111R serves as the freezing chamber 111F and the other one of the storage chambers 111F and 111R serves as the refrigerating chamber 111R.

As shown in FIG. 2, in order to rotatably install the freezing chamber door 20F and the refrigerating chamber door 20R on the main body 10, upper hinge modules 30 are installed at both sides of the upper surface of the main body 10 so as to enable the upper end of one side of each of the two doors 20 to be rotatably installed on the upper surface of the main body 10, and lower hinge modules 40 are installed at both sides of the lower surface of the main body 10 so as to enable the lower end of the side of each of the two doors 20 to be rotatably installed on the lower surface of the main body 10.

An upper hinge recess 20*a* is provided on the upper end of one side of each of the two doors 20, and a lower hinge recess 20*b* is provided on the lower end of one side of each of the two doors 20. One side of the upper end of each door 20 is rotatably installed on the main body 10 through an upper hinge 31*a* and the upper hinge recess 20*a* and one side of the lower end of each door 20 is rotatably installed on the main body 10 through a lower hinge 43 and the lower hinge recess 20*b*, thereby allowing the two doors 20 to be rotatably installed on the main body 10.

Figure 3:
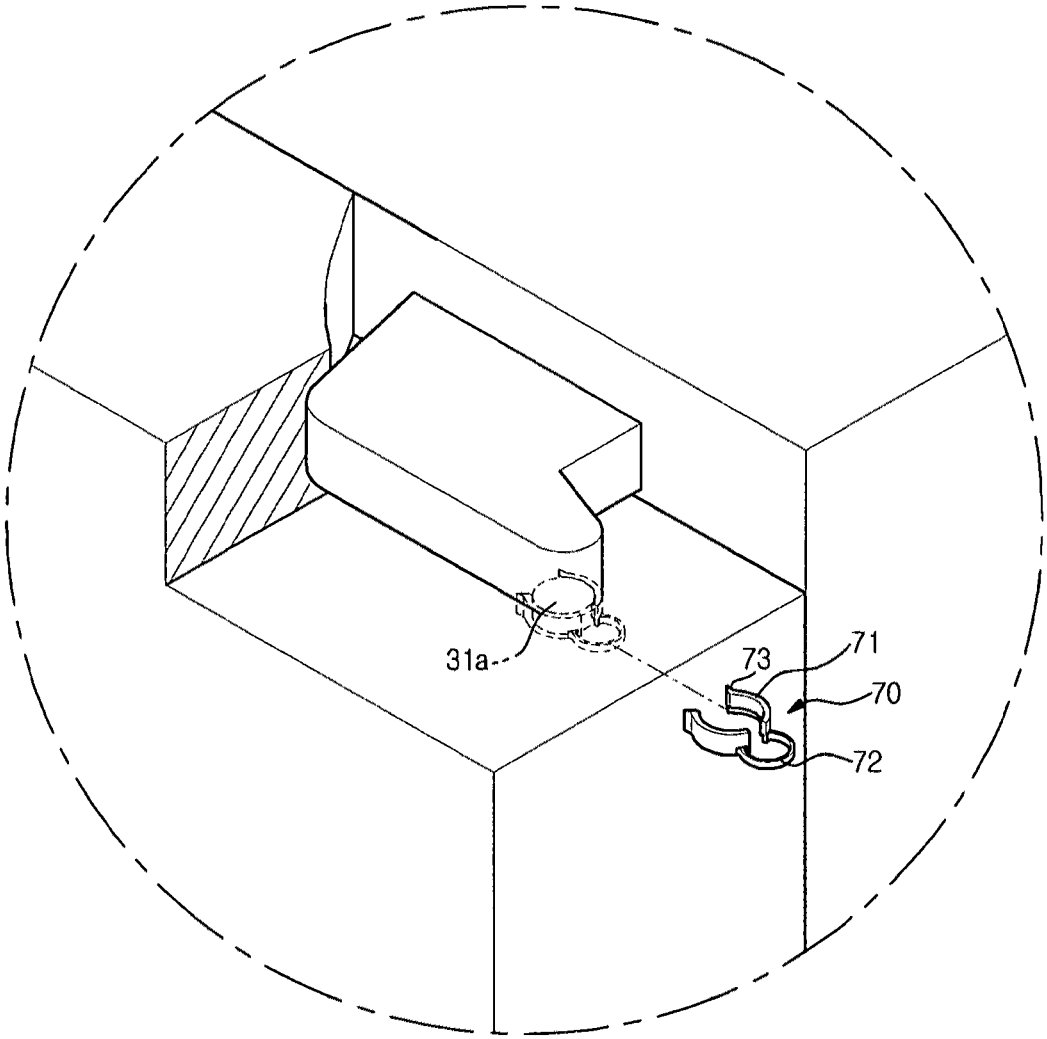
FIG. 3 is a perspective view illustrating a mounting state of an upper hinge module applied to the refrigerator in accordance with the embodiment of the present invention.
Figure 4:
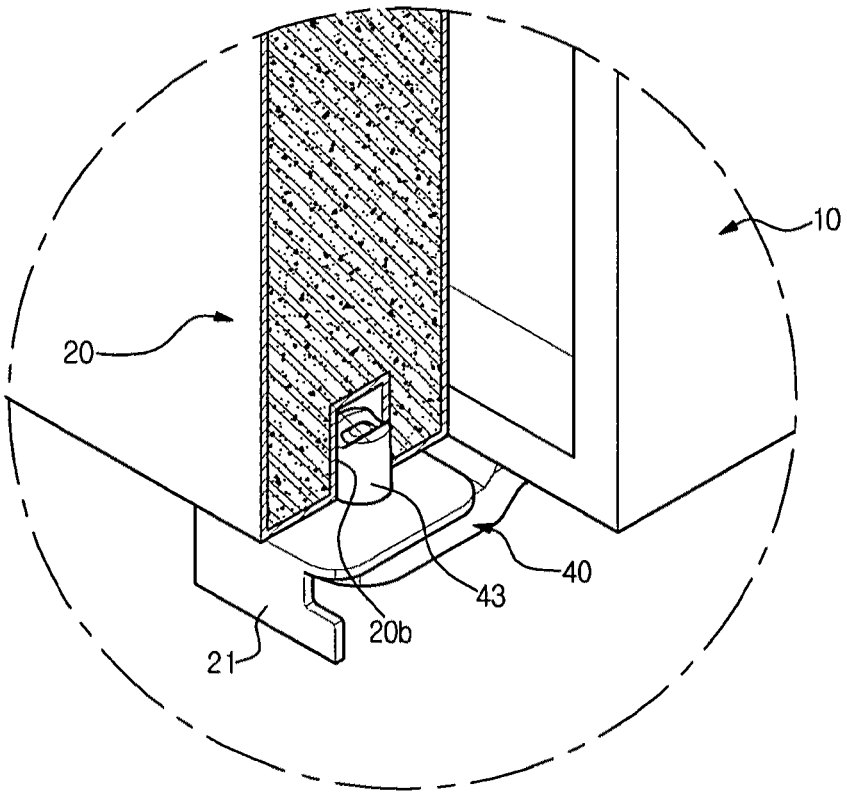
FIG. 4 is a perspective view illustrating a mounting state of a lower hinge module applied to the refrigerator in accordance with the embodiment of the present invention.

Therefore, as shown in FIG. 4, the rear ends of the two lower hinge modules 40 are installed on the outer lower surface of the outer case 100 of the main body 10 and the front ends of the two lower hinge modules 40 are installed on the lower surface of the two doors 20, thereby bearing loads of the two doors 20 through the lower hinges 43 installed in the lower hinge recesses 20*b* of the doors 20 and simultaneously rotatably supporting one side of the lower end of each of the two doors 20. Further, as shown in FIG. 3, the two upper hinge modules 30 are disposed on the upper surfaces of the two doors 20, thereby allowing the two doors 20 to be rotated in an upright state through the upper hinges 31*a* installed in the upper hinge recesses 20*a* of the doors 20 to open and close the storage chambers 111F and 111R.

In a conventional refrigerator, both side surfaces and a lower surface of an outer case of a main body are prepared as separate members, and thus fixing members to fix regions connecting the side surfaces and the lower surface of the outer case are installed at the outer surfaces of connection parts between the side surfaces and the lower surface of the outer case. Thereby, the quality of an external appearance of the refrigerator may be lowered.

On the other hand, in this embodiment, the main frame 101 integrally forms the lower surface and both side surfaces of the outer case 100 of the main body 10, and thus connection parts between the lower surface and the side surfaces of the outer case 100 are not formed, thereby preventing lowering of the quality of the external appearance of the refrigerator due to installation of separate members.

In this embodiment, in order to reinforce strength of regions in which the lower hinge modules 40 are mounted to allow the lower hinge modules 40 to be stably mounted on the lower surface of the main body 10, a lower reinforcing frame 108 (with reference to FIG. 8) is mounted on the inner lower surface of the outer case 100.

Figure 5:
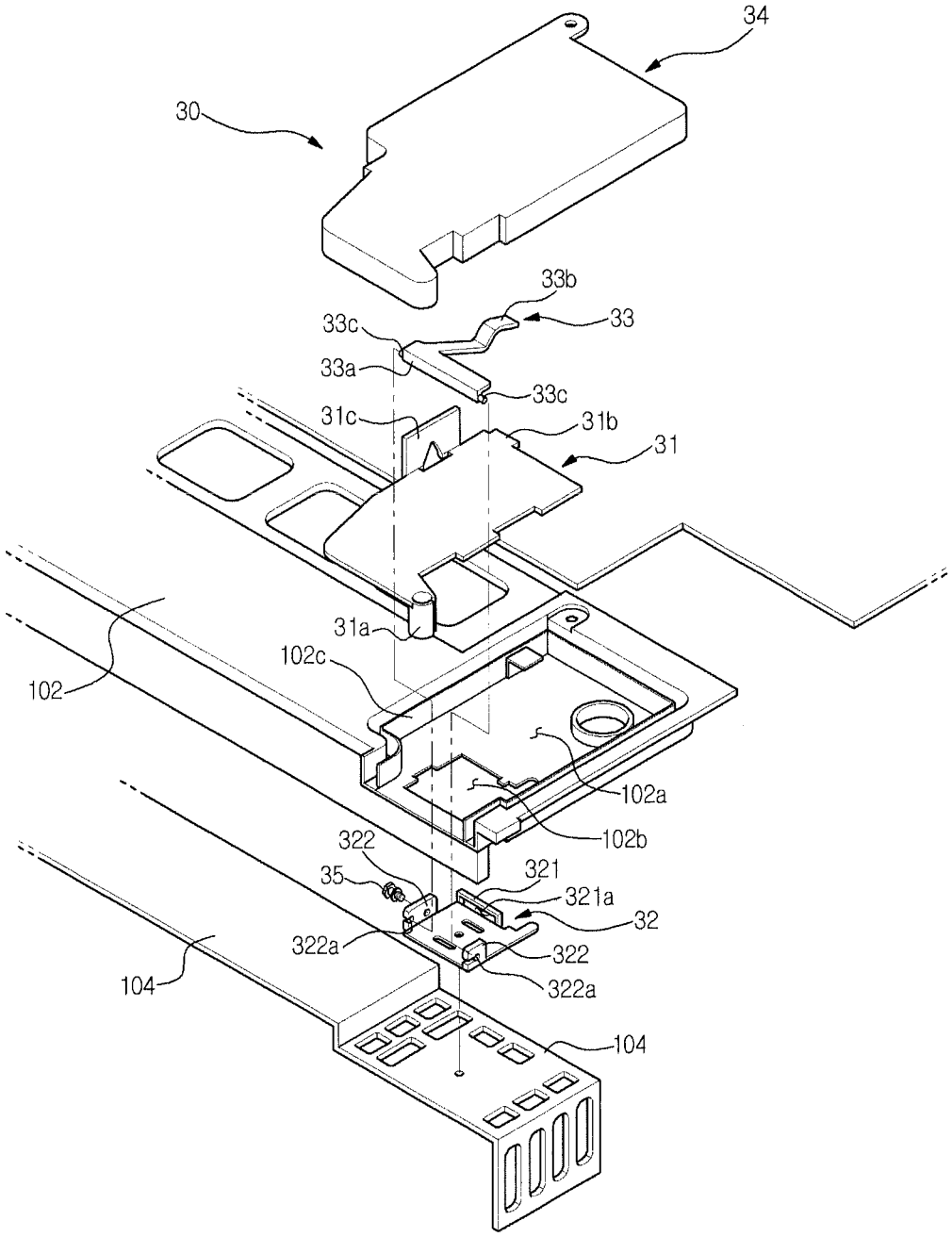
FIGS. 5 to 7 are views illustrating the mounting state of the upper hinge module applied to the refrigerator in accordance with the embodiment of the present invention.
Figure 6:
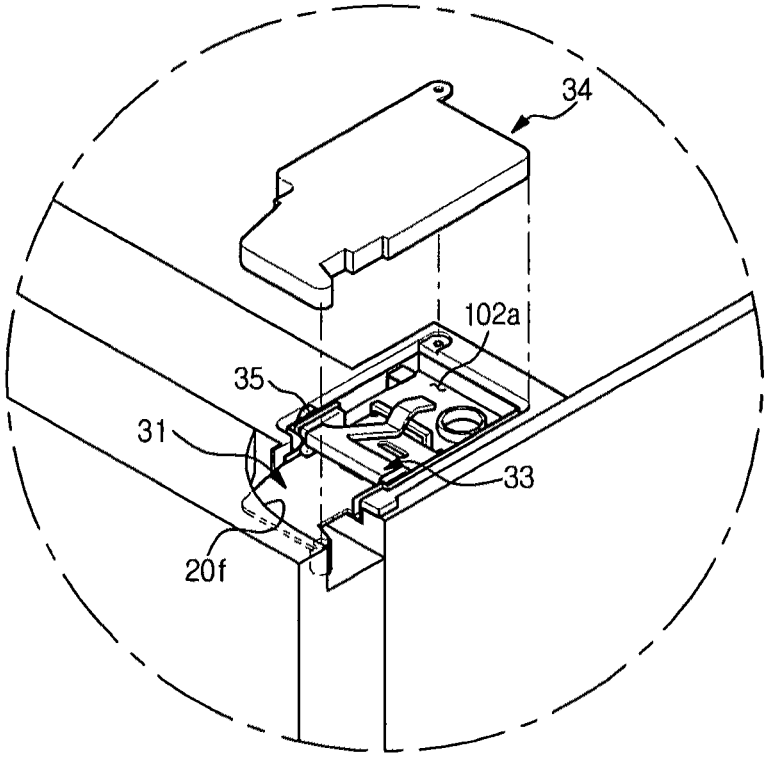

The upper hinge module 30, as shown in FIGS. 5 and 6, includes an upper hinge bracket 31 on which the upper end of the door 20 is rotatably installed, a fixing bracket 32 fixed to the upper surface of the main body 10 to fix the rear end of the upper hinge bracket 31 to the main body 10, a fixing lever 33 detachably and rotatably installed on the fixing bracket 32 to selectively apply pressure to the upper hinge bracket 31 to be supported by the fixing bracket 32 according to a rotation angle of the fixing lever 33, and a hinge cover 34 to cover the upper hinge bracket 31, the fixing bracket 32, and the fixing lever 33.

In order to prevent the door 20 from moving due to vibration generated during transportation of the refrigerator, a movement preventing member 70, as shown in FIG. 3, is installed between the upper hinge module 30 and the door 20. The movement preventing member 70 is separably installed on the upper hinge 31*a* to maintain a gap between the upper surface of the door 20 and the upper hinge bracket 31, thereby preventing the door 20 from moving.

Such a movement preventing member 70 includes a pair of hinge support parts 71 respectively formed in an arc shape and supported by both sides of the upper hinge 31*a*, an elastic part 72 formed in an arc shape and connecting one end of each of the two hinge support parts 71 to each other to allow the two hinge support parts 71 to be elastically supported by the upper hinge 31*a*, and insertion guides 73, each of which is provided at the other end of each of the two hinge support parts 71, to guide the upper hinge 31*a* to a space between the two hinge supports 71.

Therefore, while the refrigerator is transported, the movement preventing member 70 is installed at the upper hinge 31*a* such that the upper hinge bracket 31 and the door 20 are supported by each other via the movement preventing member 70 so as to prevent the door 20 from moving, and after installation of the refrigerator has been completed, the movement preventing member 70 is separated from the upper hinge 31*a* such that the door 20 is smoothly rotated.

The fixing bracket 32 includes a first support 321 extended upward from the rear end of the fixing bracket 32 to support the rear end of the upper hinge bracket 31, and a pair of second supports 322 extended upward from both side ends of the fixing bracket 32 to rotatably mount the fixing lever 33 therebetween. A support hole 321*a* into which the rear end of the upper hinge bracket 31 is inserted is provided on the first support 321, and lever mount grooves 322*a* into which both sides of the fixing lever 33 are rotatably installed are provided on the second supports 322.

The rear end of the upper hinge bracket 31 is fixed to the upper surface of the main body 10 through the fixing bracket 32, and the front end of the upper hinge bracket 31 is protruded forward from the main body 10. Further, the upper hinge bracket 31 includes the upper hinge 31*a* protruded downward from the front end of the upper hinge bracket 31 and rotatably installed at the upper end of the door 20, and a support protrusion 31*b* protruded from the rear end of the upper hinge bracket 31 and inserted into the support hole 321*a*.

In this embodiment, the upper hinge module 30 is configured such that the upper hinge bracket 31 moves in the rightward and leftward directions to adjust the upper end of the door 20 within a designated length in the rightward and leftward directions. For this purpose, an adjustment guide 31*c* arranged in parallel with one of the two second supports 322 is provided at one side of the upper hinge bracket 31, and an adjustment screw 35 rotated to move the upper hinge bracket 31 is installed on the corresponding second support 322. Therefore, the upper hinge bracket 31 moves in the rightward and leftward directions by rotating the adjustment screw 35 so as to change an interval between the second support 322 and the adjustment guide 31*c*, and when the upper hinge bracket 31 moves, the upper end of the door 20 rotatably installed on the main body 10 through the upper hinge bracket 31 moves in the rightward and leftward directions.

Figure 7:
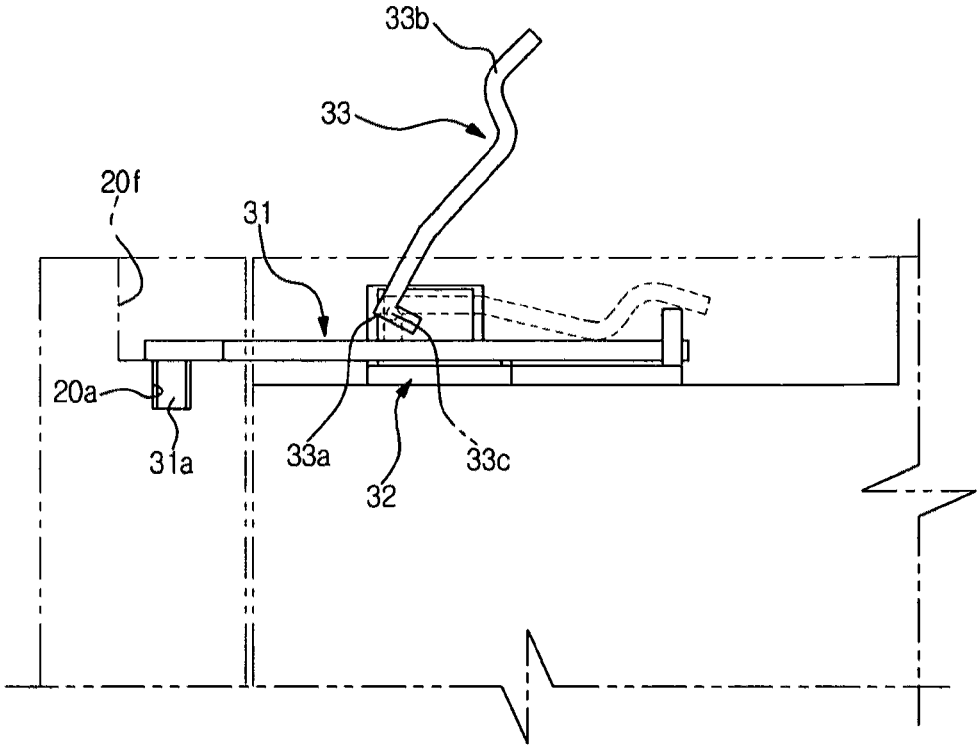

The fixing lever 33, as shown in FIG. 7, includes a pressure part 33*a* provided at the front end of the fixing lever 33 and applying pressure to the upper hinge bracket 31 according to a rotation angle of the fixing lever 33 to attach the upper hinge bracket 31 to the fixing bracket 32, a lever part 33*b* provided at the rear end of the fixing lever 33 to allow a worker to easily rotate the fixing lever 33, and a pair of hinge protrusions 33*c* provided at both sides of the fixing lever 33 to rotatably install the fixing lever 33 on the fixing bracket 32.

Figure 23:
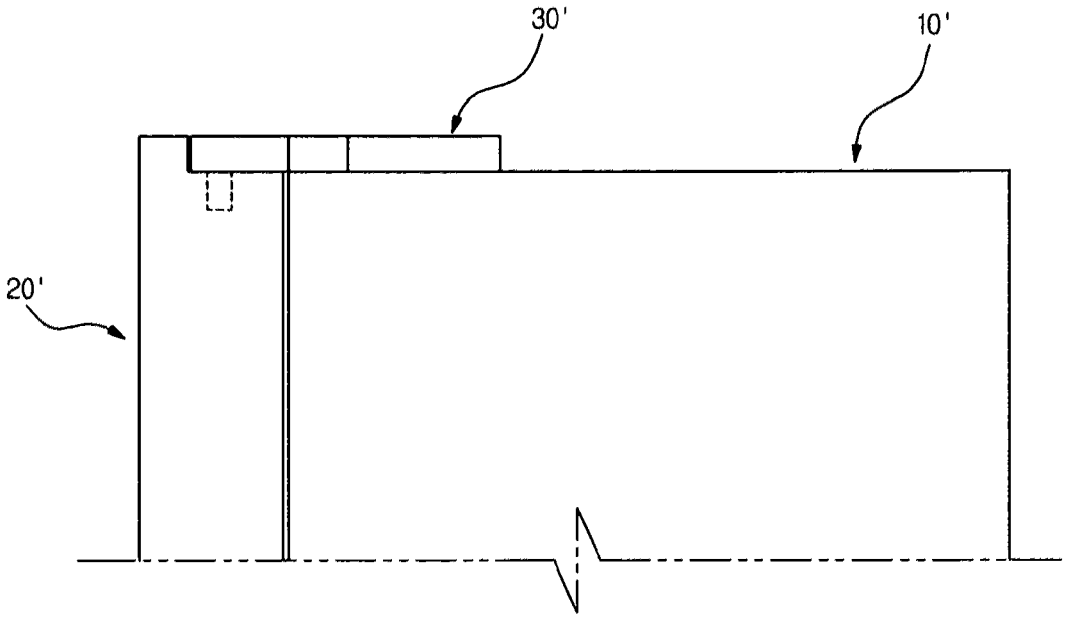
FIG. 23 is a perspective view illustrating a mounting state of an upper hinge module applied to a conventional refrigerator.

Here, the upper hinge module 30 includes the upper hinge bracket 31, the fixing bracket, the fixing lever 33, and the hinge cover 23, as described above, and thus inevitably has a designated thickness in the vertical direction. In the conventional refrigerator, as shown in FIG. 23, if an upper hinge module 30' having a designated thickness, is installed on the upper surface of a main body 10', the upper hinge module 30' is protruded upward from the main body 10', and the upper end of a door 20' is located at a height corresponding to the upper surface of the upper hinge module 30' so as to shield the upper hinge module 30' protruded upward from the main body 10'. In this case, the height of the refrigerator is determined by the door 20' being relatively high and the height of the main body 10' is lower than that of the door 20', and thus the height of the main body 10' becomes lower than that of the door 20', i.e., that of the refrigerator, thereby reducing a volume of storage chambers formed in the main body 10'.

Therefore, in this embodiment, as shown in FIGS. 5 and 6, main body hinge receipt parts 102*a* to receive the rear ends of the upper hinge modules 30 are provided on the upper surface of the main body 10, and a door hinge receipt part 20*f* to receive the front end of each of the upper hinge module 30 is provided on the upper surface of the door 20.

The main body hinge receipt part 102*a* is depressed to a depth corresponding to the thickness of the upper hinge module 30, and the front end of the main body hinge receipt part 102*a* is opened so as to allow the front end of the upper hinge module 30 to be protruded forward from the main body 10. Further, a support rib 102*c* separated from the inner wall of the main body hinge receipt part 102*a* is provided in the main body hinge receipt part 102*a*, and the side surface of the hinge cover 34 is supported by the support rib 102*c*.

The door hinge receipt part 20*f* is depressed at one side of the rear surface of the door 20 so as to receive the front end of the upper hinge module 30, and the above-described upper hinge recess 20*a* is provided on the lower surface of the inside of the door hinge receipt part 20*f*.

Since the main body hinge receipt part 102*a* is provided on the upper surface of the main body 10 in such a manner, if the rear end of the upper hinge module 30 is installed in the main body hinge receipt part 102*a* and the front end of the upper hinge module 30 is installed in the door hinge receipt part 20*f*, the rear end of the upper hinge module 30 is embedded in the upper surface of the main body 10 and the front end of the upper hinge module 30 is received in the door hinge receipt part 20*f*, and thus the upper surface of the main body 10 is located at a height corresponding to that of the upper surface of the door 20.

In this embodiment, the upper surface of the upper hinge module 30, i.e., the upper surface of the hinge cover 34, is located at the same height as the upper end of the door 20 and the upper surface of the main body 10, thereby preventing an increase in the height of the refrigerator or lowering of the quality of the external appearance of the refrigerator generated when the upper hinge module 30 is protruded upward from the main body 10.

Further, if the upper hinge module 30 is embedded in the upper surface of the main body 10, as in this embodiment, the upper surface of the main body 10 is located at the same height as the upper surface of the upper hinge module 30 and the upper end of the door 20, and thus the main body 10 having a greater height may be applied to the refrigerator a the designated height, thereby securing a greater volume of the storage chambers 111F and 111R in the main body 10.

The refrigerating chamber 111R and the freezing chamber 111F are horizontally provided in parallel in the refrigerator and one side of the refrigerating chamber door 20R and one side of the freezing chamber door 20F are rotatably installed at both sides of the main body 10. Therefore, a pair of upper hinge modules 30 is provided and the main body hinge receipt parts 102*a* are respectively provided at both sides of the upper surface of the main body 10 so as to rotatably support the upper end of one side of each of the two doors 20.

As described above with reference to FIG. 8, the outer case 100 includes the main frame 101 formed in a U shape and the upper frames 102 and 103. This serves to easily form the main body hinge receipt parts 102*a* on the upper surface of the outer case 100.

That is, an outer case applied to the conventional refrigerator includes a main frame obtained by bending a plate member made of metal in a reverse U shape to form upper and both side surfaces of the outer case, and in order to embed upper hinge modules in the upper surface of a main body, main body hinge receipt parts need to be formed by partially deforming the upper surface of the main frame made of metal relatively scarcely deformable. Therefore, in case of the conventional refrigerator, as shown in FIG. 23, instead of forming of the main body hinge receipt parts by deforming the upper surface of the refrigerator, which is scarcely deformable, the upper hinge modules 30' are installed on the main body 10' under the condition that the upper hinge modules 30' are protruded upward from the main body 10'.

However, as in this embodiment, if the upper frames 102 and 103 forming the upper surface of the outer case 100 are prepared as members provided separately from the main frame 101, the upper frames 102 and 103 provided with the main body hinge receipt parts 102*a* are manufactured separately from the main frame 101 and are then installed on the main frame 101 formed by bending the plate member made of metal in a U shape, thereby simply manufacturing the outer case 100 provided with the main body hinge receipt parts 102*a*.

In this embodiment, the upper frames 102 and 103 include a first upper frame 102 provided with the main body hinge receipt parts 102*a* at both sides thereof to form the front portion of the upper surface of the outer case 100, and a second upper frame 103 disposed at the rear of the first upper frame 102 to form the rear portion of the upper surface of the outer case 100 and thus to form the upper surface of the outer case 100, i.e., the upper surface of the main body 10, together with the first upper frame 102. Here, the first upper frame 102 is made of resin so as to easily mold the main body hinge receipt parts 102*a*, and the second upper frame 103 is made of metal so as to have sufficient strength.

Since resin has a higher heat insulating property than metal as well as is easily molded into a designated shape through an injection mold, although the thickness of partial regions of the upper end of the main body 10 provided with the main body hinge receipt parts 102*a* is decreased during a process of forming the main body hinge receipt parts 102*a* on the upper surface of the main body 10, a region of the upper end of the main body 10 in which the first upper frame 102 made of resin is disposed may have a heat insulating ability similar to a region of the upper end of the main body 10 in which the second upper frame 103 made of metal is disposed.

Although this embodiment illustrates that the upper frames 102 and 103 include the first upper frame 102 and the second upper frame 103 manufactured separately, an upper frame may be prepared as a single member.

If the upper hinge module 30 is mounted in the main body hinge receipt part 102*a* provided on the first upper frame 102 made of resin, as described above, load of the door 20 may be applied to the first upper frame 102 through the upper hinge module 30. Therefore, an upper reinforcing frame 104 made of metal to reinforce strength of the first upper frame 102 made of resin is disposed under the first upper frame 102. Both sides of the upper reinforcing frame 104 are bent downward so as to correspond to the lower surfaces of the main body hinge receipt parts 102*a* of the first upper frame 102. In this embodiment, a through hole 102*b* is formed through the main body hinge receipt part 102 such that the fixing bracket 32 is fixed directly to the upper reinforcing frame 104 through the through hole 102*b*. If the fixing bracket 32 is installed on the upper reinforcing frame 104, the load of the door 20 is supported by the upper reinforcing frame 104 made of metal instead of the first upper frame 102 made of resin, and thus the mounting state of the door 20 on the main body 10 is stably maintained.

Further, the upper reinforcing frame 104 serves to allow both side surfaces of the main frame 101 to be supported by each other. For this purpose, frame support parts 101*a* supporting both ends of the upper reinforcing frame 104 are provided at the upper portions of both inner side surfaces of the main frame 101, and insertion parts 104*b* extended downward to be inserted into the frame support parts 101*a* are provided at both ends of the upper reinforcing frame 104.

Figure 9:
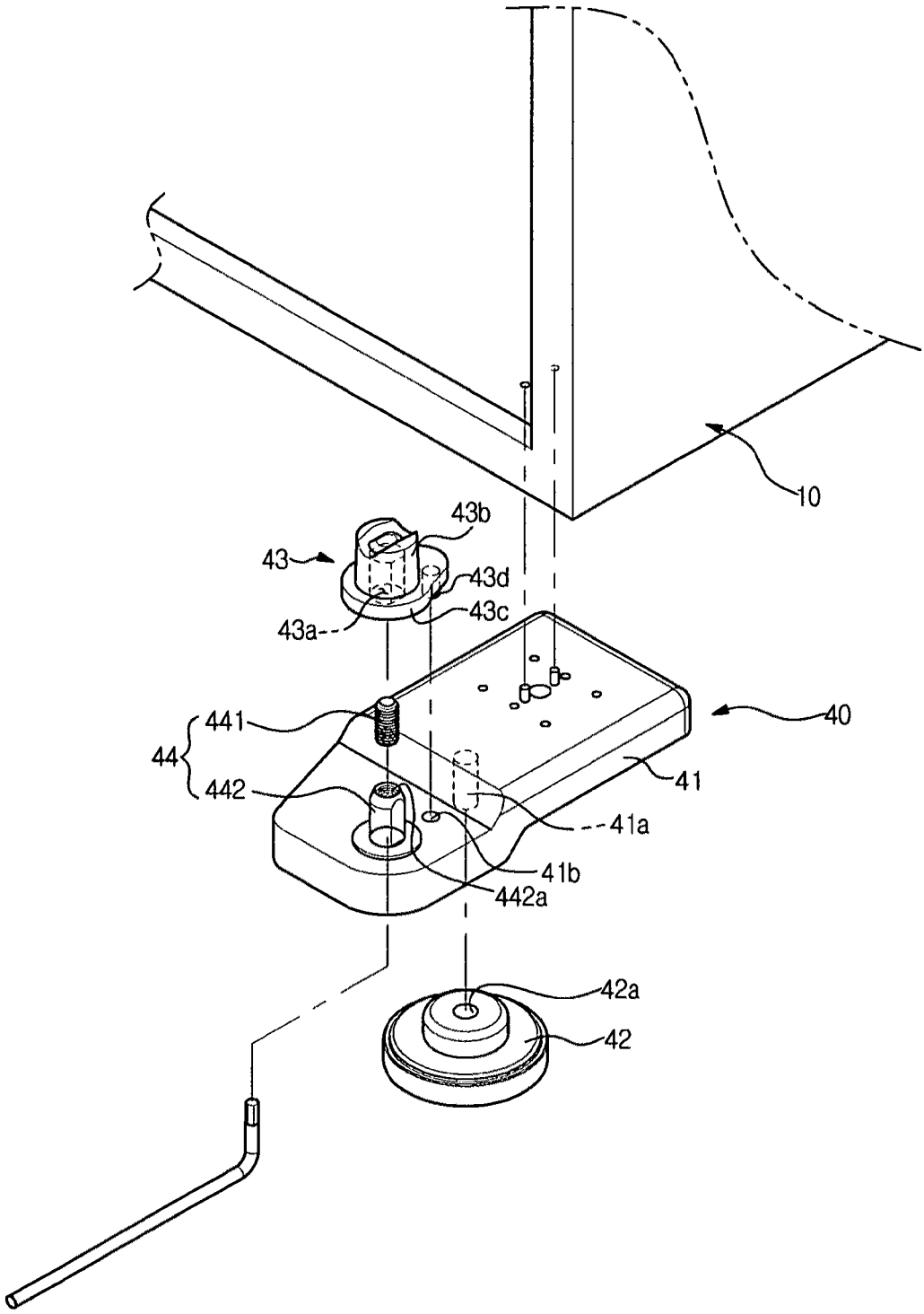
FIG. 9 is an exploded perspective view of the lower hinge module applied to the refrigerator in accordance with the embodiment of the present invention.
Figure 10:
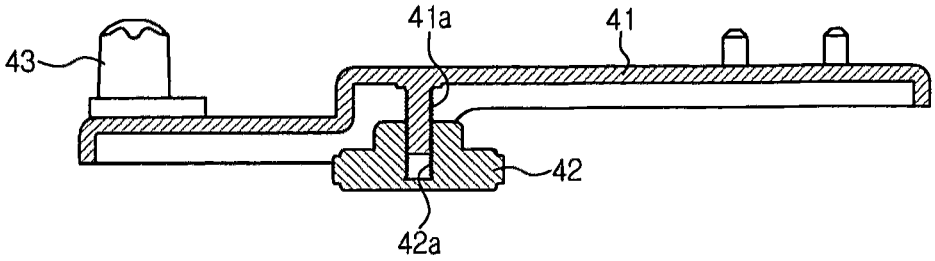
FIGS. 10 and 11 are longitudinal-sectional views illustrating a door height adjusting method through the lower hinge module applied to the refrigerator in accordance with the embodiment of the present invention.

The lower hinge module 40, as shown in FIGS. 9 and 10, includes a lower hinge bracket 41 provided with a rear end installed on the lower surface of the outer case 100 and a front end protruded forward from the main body 10 and extended under the door 20 installed in front of the main body 10, a leg 42 installed on the lower hinge bracket 41 and disposed under the lower hinge bracket 41 to allow the lower hinge bracket 41 and the main body 10 provided with the lower hinge bracket 41 to rest on the ground, the lower hinge 43 disposed at the front end of the lower hinge bracket 41 to rotatably support one side of the lower end of the door 20, and an elevating device 44 vertically moving the lower hinge 43 to move the door 20 in the vertical direction within a designated range.

The leg 42 is screw-connected with the lower hinge bracket 41 and is rotated so as to be vertically movable relative to the lower hinge bracket 41. Therefore, the leg 42 is rotated so as to vertically move, thereby allowing the main body 10 to rest on the ground through the leg 42 and the lower hinge bracket 41. Further, leveling of the main body 10 is achieved by moving the lower hinge bracket 41 and the main body 10 upward within a designated range by rotating the leg 42 under the condition that the leg 42 rests on the ground.

In order to screw-connect the leg 42 with the lower hinge bracket 41, a male screw part 41*a* provided with a male screw on the outer circumferential surface thereof is formed on the lower hinge bracket 4, and a fastening hole 42*a* provided with a female screw on the inner circumferential surface thereof is formed on the leg 42.

Figure 11:
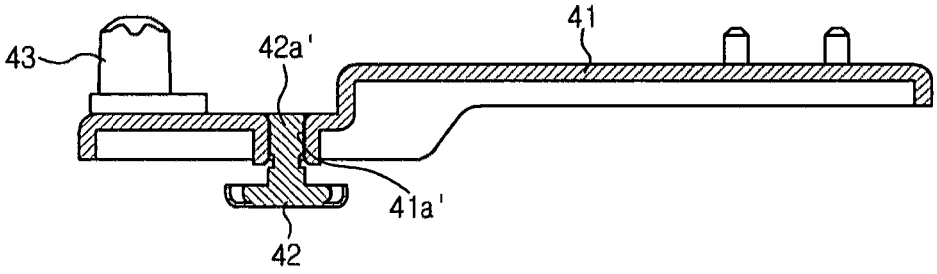

Although this embodiment illustrates that the male screw part 41*a* is formed on the lower hinge bracket 41 and the fastening hole 42*a* is formed on the leg 42, a screw-connection structure between the lower hinge bracket 41 and the leg 42 is not limited thereto. Conversely, as shown in FIG. 11, a male screw part 41*a*' may be formed on the leg 42 and a fastening hole 42*a*' may be formed on the lower hinge bracket 41.

The elevating device 44 includes an elevating member 441 vertically movably installed on the lower hinge bracket 41 to vertically move the lower hinge 43, and an elevating guide 442 installed at the front end of the lower hinge bracket 41 to allow the elevating member 441 to be vertically movably installed on the lower hinge bracket 41.

A male screw is formed on the outer circumferential surface of the elevating member 441, and a guide hole 442*a* vertically penetrating the elevating guide 442 and provided with a female screw on the inner circumferential surface of the guide hole 442*a* so as to be screw-connected with the elevating member 441 is provided on the elevating guide 442.

The lower hinge 43 includes a hinge part 43*b* inserted into the lower hinge recess 20*b* and provided with a guide receipt recess 43*a* to receive the elevating guide 442, and a door support part 43*c* extended from the lower end of the hinge part 43*b*, formed in a ring shape, and supported by a portion of the door 20 adjacent to the lower hinge recess 20*b*.

Further, a latch part 43*d* is extended downward from the door support part 43*c* of the lower hinge 43 so as to prevent the lower hinge 43 from being rotated together with rotation of the elevating member 441 and the elevating guide 442 while the user rotates the elevating member 441, and a latch hole 41*b* into which the latch part 43*d* is inserted is provided on the lower hinge bracket 41.

Figure 12:
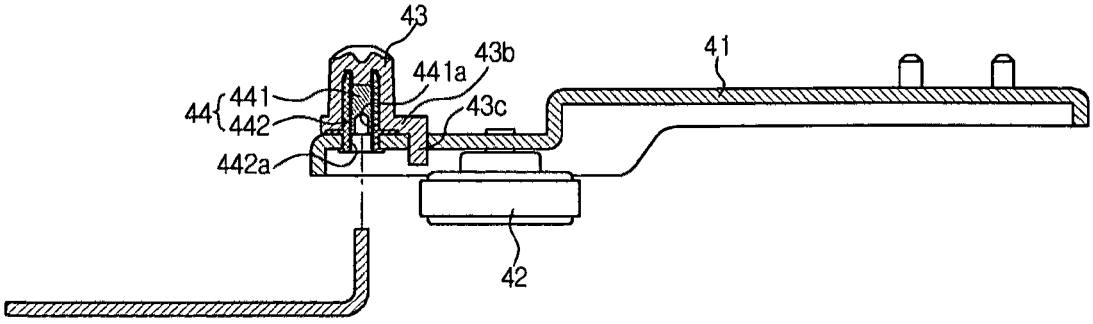
FIG. 12 is a longitudinal-sectional view of the lower hinge module applied to the refrigerator in accordance with the embodiment of the present invention.
Figure 13:
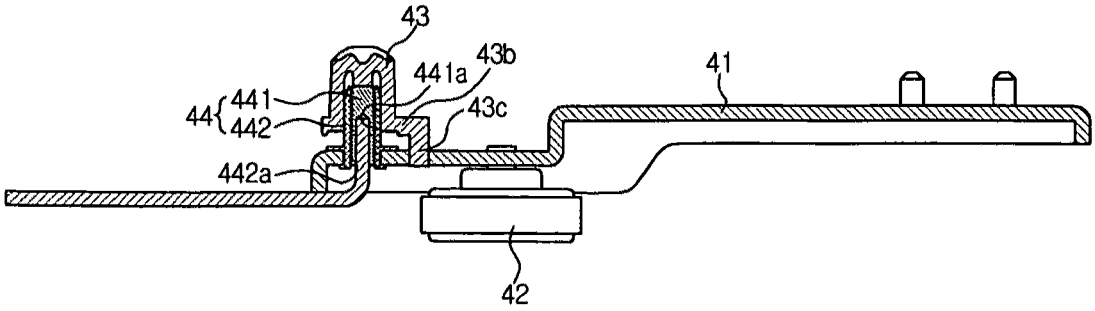
FIG. 13 is a longitudinal-sectional view of a lower hinge module applied to a refrigerator in accordance with another embodiment of the present invention.

In order to rotate the elevating member 441 using transmitted external force, a polygonal recess 441*a* is provided on the lower surface of the elevating member 441, as shown in FIGS. 12 and 13. Therefore, the elevating member 441 is rotated using rotary force, which is applied by a tool, such as a hexagonal wrench, and is then transmitted through the polygonal recess 441*a*, and then moves upward or downward according to a rotating direction thereof. The lower hinge 43 moves upward or downward as the elevating member 441 moves upward or downward, and the door 20 supported by the door support part 43*c* of the lower hinge 43 moves upward and downward together with upward or downward movement of the lower hinge 43. Therefore, the door 20 is moved upward and downward so as to be precisely located at a designated position in front of the main body 10 by rotating the elevating member 441.

Stoppers 21 (with reference to FIG. 2) disposed facing the front ends of the lower hinge brackets 41 to limit the rotation angle of the doors 20 are disposed at the lower ends of the two doors 20. In this embodiment, the stopper 21 having a designated width in the widthwise direction of the door 20 is formed in front of the lower hinge bracket 41, and is latched to the side surface of the lower hinge bracket 41 as the door 20 is opened, thereby limiting the rotation angle of the door 20 to less than a designated angle. Further, since the stopper 21 is disposed in front of the lower hinge bracket 41, the stopper 21 serves to shield the lower hinge bracket 41 under the closed state of the door 20 such that the lower hinge bracket 41 is not seen from the front of the refrigerator.

Figure 24:
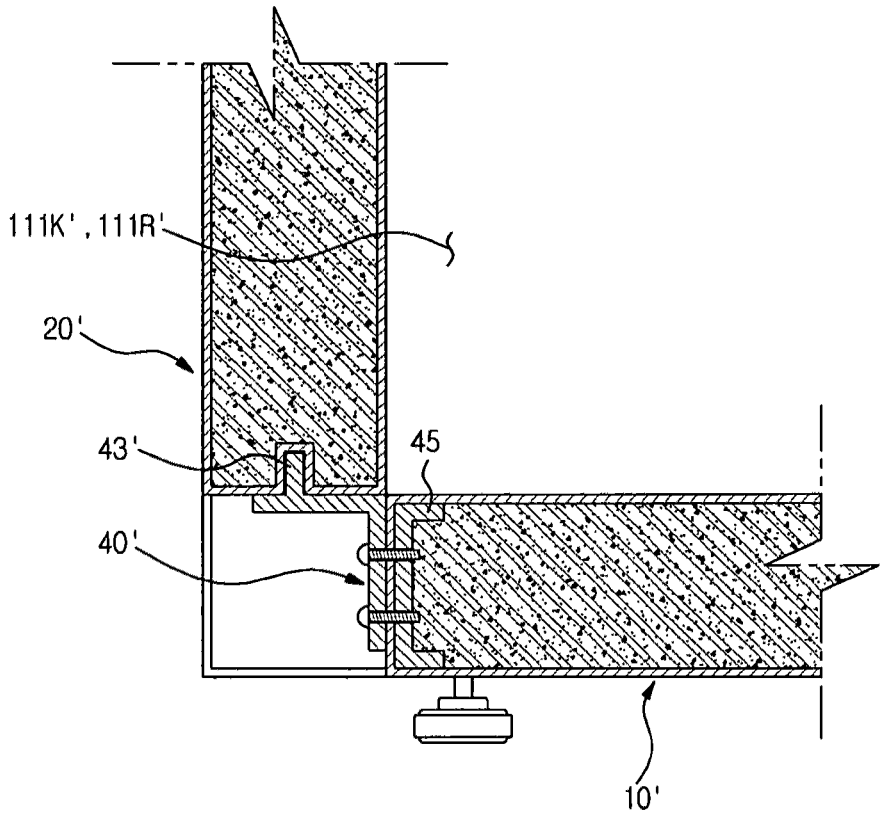
FIG. 24 is a perspective view illustrating a mounting state of a lower hinge module applied to the conventional refrigerator.

As shown in FIG. 24, a general lower hinge module 40' applied to the conventional refrigerator is fixed to the lower portion of the front surface of the main body 10'. In case of the lower hinge module 40' fixed to the lower portion of the front surface of the main body 10', in order to stably support load of the door 20', at least two points of the lower hinge modules 40' vertically separated from each other are fixed to the lower portion of the front surface of the main body 10', and in order to enable the lower hinge module 40' to support load of the door 20', a reinforcing member 45 made of metal is disposed at the inside of the lower end of the main body 10'. In order to obtain a space in which the lower hinge module 40' and the reinforcing member 45 are installed, the thickness of the lower end of the main body 10' of the conventional refrigerator needs to be greater than the height of the hinge module 40' and the height of the reinforcing member 45, and thereby a volume of storage chambers 111F' and 111R' is reduced.

However, if the above-described lower hinge modules 40 are installed on the lower surface of the main body 10 in such a manner, the thickness of the lower end of the main body 10 is maximally reduced as far as a proper heat insulating ability is maintained, and this means that the height of the lower ends of the storage chambers 111F and 111R is maximally lowered. Thereby, a greater volume of the storage chambers 111F and 111R is secured within the main body 10 having the same height.

As described above, if the height of the upper surface of the main body 10 is raised so as to be equal to the height of the upper surfaces of the upper hinge modules 30 by embedding the upper hinge modules 30 in the upper surface of the main body 10 and the thickness of the lower end of the main body 10 is reduced by mounting the lower hinge modules 40 on the lower surface of the main body 10, a maximally large volume of the storage chambers within the refrigerator having a designated height is obtained.

Figure 14:
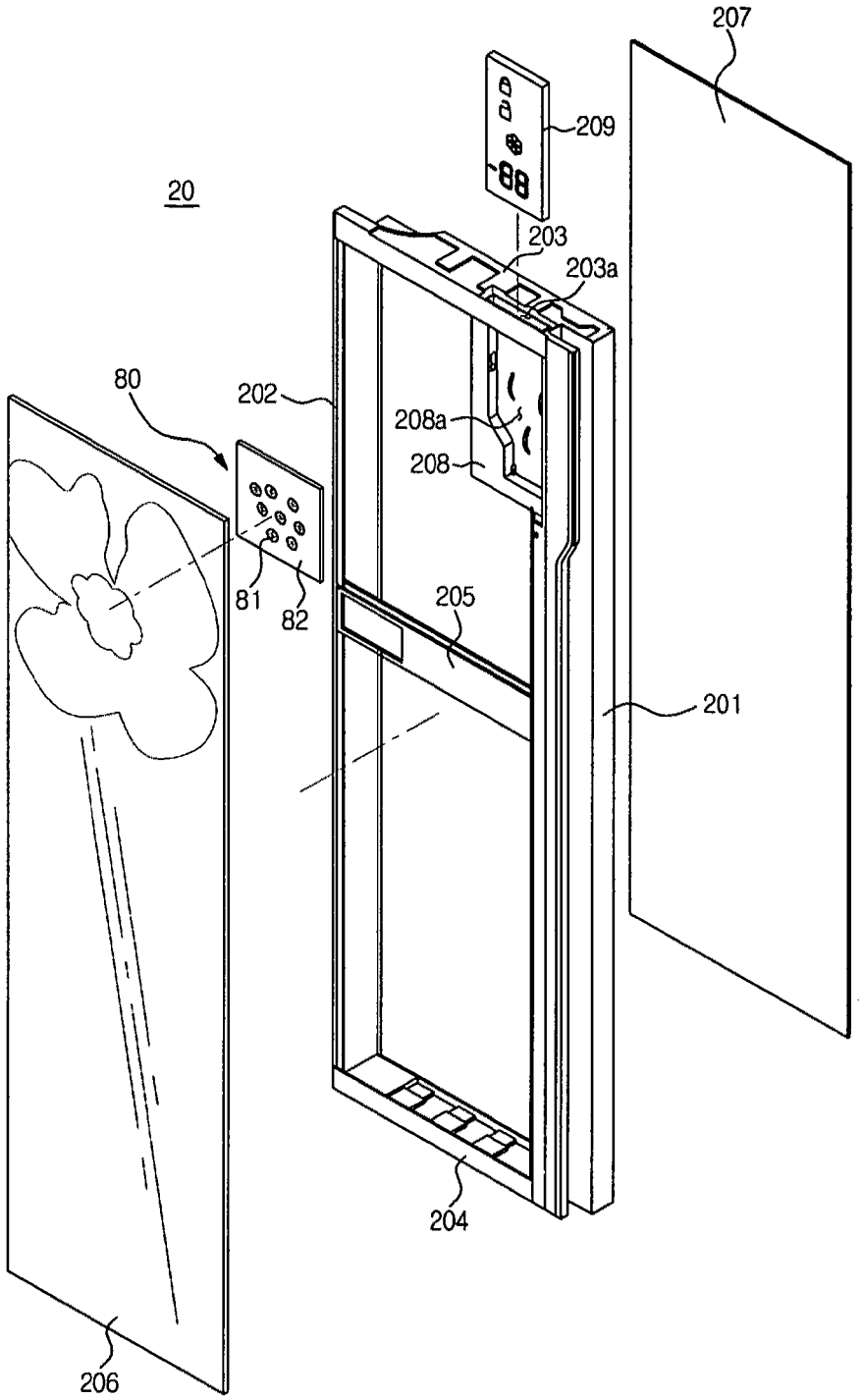
FIG. 14 is an exploded perspective view of a door applied to a refrigerator in accordance with one embodiment of the present invention.
Figure 15:
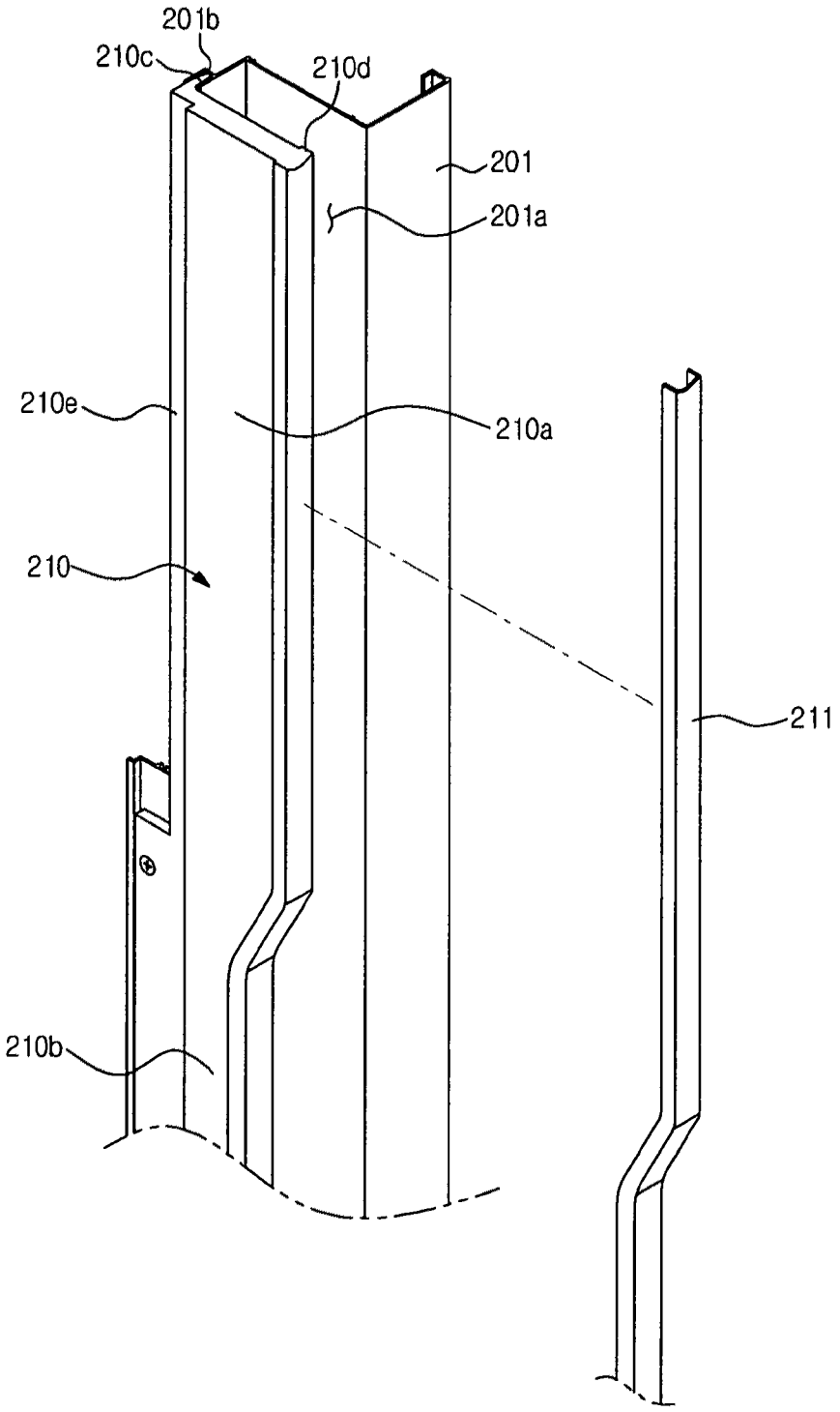
FIG. 15 is an exploded perspective view illustrating a mounting state of a handle and a door cover applied to the refrigerator in accordance with the embodiment of the present invention.

The door 20, as shown in FIGS. 14 and 15, includes a pair of door side frames 201 and 202 forming both side surfaces of the door 20, a support frame 205 provided with both ends installed on the two door side frames 201 and 202 to allow the two door side frames 201 and 202 to support each other, an upper door cap 203 and a lower door cap 204 respectively installed at the upper ends and the lower ends of the two door side frames 201 and 202 and forming upper and lower surfaces of the door 20, a door front panel 206 made of tempered glass and forming a front surface of the door 20, and a door rear frame 207 forming a rear surface of the door 20 such that a door shelf (not shown) is mounted on the door rear frame 207.

Further, a decorative unit 80 to decorate the door 20 is disposed on the rear surface of the door front panel 206. The decorative unit 80 includes a plurality of decorative members 81 to reflect or emit light, and a fixing plate 82 to which the plurality of decorative members 81 formed in a designated shape is fixed. The decorative members 81 may include jewel members made of lustrous minerals to reflect right, or light emitting members, such as LEDs emitting right.

Therefore, after the two door side frames 201 and 202, the door front panel 206, the door rear panel 207, the upper door cap 203, and the lower door cap 204 are connected to form an inner space therein, the inner space is filled with foaming resin, thereby completing formation a heat insulating member within the door 20.

Further, the door 20 includes a door trim 210 to support a side end of the door front panel 206, and a handle 210*a* and 210*b* to allow a user to easily apply force to the door 20 is extended integrally from the door trim 210. Since the doors 20 include the freezing chamber door 20F and the refrigerating chamber door 20R and the freezing chamber door 20F and the refrigerating chamber door 20R are rotatably installed at both sides of the main body 10, the two door trims 210 disposed at the two doors 20 face each other, and the two handles 210*a* and 210*b* are disposed in front of the diaphragm 112 such that the handle 210*a* and 210*b* of the freezing chamber door 20F and the handle 210*a* and 210*b* of the refrigerating chamber door 20R face each other.

If the handle 210*a* and 210*b* is formed integrally with the door trim 210, as described above, the handle 210*a* and 210*b* is installed on the door 20 by installing the door trim 210 on the door 20, and thus the handle 210*a* and 210*b* is simply installed.

The door trim 210 is installed on any one of the two door side frames 201 and 202 provided on the respective two doors 20. The door side frames 201 and 202 of the two doors 20 include a pair of first door side frames 201 forming side surfaces of the two doors 20 facing each other and respectively provided with the above-described door trims 210 installed thereon, and a pair of second door side frames 202 forming the other side surfaces of the two doors 20. Since the handle 210*a* and 210*b* of one door 20 and the handle 210*a* and 210*b* of the other door 20 face each other, as described above, the two first door side frames 201 of the two doors 20 are disposed in front of the diaphragm 112 such that the first door side frame 201 of one door 20 and the first door side frame 201 of the other door 20 face each other.

A handle groove 201*a* stepped so as to be opened forward and sideward is provided at one side of the first door side frame 201. The handle groove 201*a* is opened toward the neighboring first door side frame 201, and the handle 210*a* and 210*b* is extended so as to be substantially parallel with the front surface of the door 20 and then cover the front portion of the handle groove 201*a*. In order to install the door trim 210 on the first door side frame 201, a trim mount groove 201*b* running parallel with the handle groove 201*a* is installed at a part of the first door side frame 201 adjacent to the handle groove 201*a*, and a trim mount part 210*c* installed in the trim mount groove 210*b* is provided on the door trim 210.

The handle 210*a* and 210*b* includes a first handle part 210*a* formed to cover the entirety of the handle groove 201*a*, and a second handle part 210*b* extended to a smaller length than the first handle part 210*a* to cover a part of the handle groove 201*a*.

In this embodiment, the first handle part 210*a* is provided on the upper portion of the freezing chamber door 20F and the second handle part 210*b* is provided on the lower portion of the refrigerating chamber door 20R, and conversely, the second handle part 210*b* is provided on the upper portion of the refrigerating chamber door 20R and the first handle part 210*a* is provided on the lower portion of the refrigerating chamber door 20R. Thereby, the two handles 210*a* and 210*b* provided on the two doors 20 are separated from each other, thus allowing a user to put his/her hand into a space between the two handles 210*a* and 210*b* so as to easily grip the handles 210*a* and 210*b*.

Further, a panel support part 210*e* supporting the door front panel 206 is depressed on one end of the handle 210*a* and 210*b* located opposite to the other end of the handle 210*a* and 210*b* provided with the first handle part 210*a* and the second handle part 210*b*. Therefore, after the edge of the rear surface of the door front panel 206 is attached to the front surface of the first door side frame 201, the panel support part 210*e* of the handle 210*a* and 210*b*, and the front surfaces of the upper door cap 203 and the lower door cap 204 by a double-sided adhesive tape, a foaming resin fills a space formed by the door front panel 206, the door rear frame 207, the first door side frame 201, the second door side frame 202, the upper door cap 203, and the lower door cap 204, thereby forming the heat insulating member within the door 20. Then, since the resin forming the heat insulating member is solidified under the condition that the resin is attached to the rear surface of the door front panel 206 during a formation process of the heat insulating member, the door front panel 206 is supported by the heat insulating member attached to the rear surface thereof.

In this embodiment, the handle 210*a* and 210*b* is made of a transparent member, and a handle cover 211 made of metal and serving to achieve a decorative effect and to increase durability of the handle 210*a* and 210*b* is disposed at the front end of the handle 210*a* and 210*b*. A relatively thick grip part 210*d* to stably install the handle cover 211 and to allow the user to easily grip the handle 210*a* and 210*b* is provided at the front end of the handle 210*a* and 210*b*, and the handle cover 211 covers the grip part 210*d*.

Further, a display unit 209 to display an operating state of the refrigerator is installed on the door 20. In order to install the display unit 209, a display frame 208 provided with a display receipt part 208*a*, in which the display unit 209 is received, is provided at the inside of the first door side frame 201. In order to install the display unit 209, a display insertion hole 203*a* through which the display unit 209 is inserted into the display receipt part 208*a* is provided on the upper door cap 203.

Figure 16:
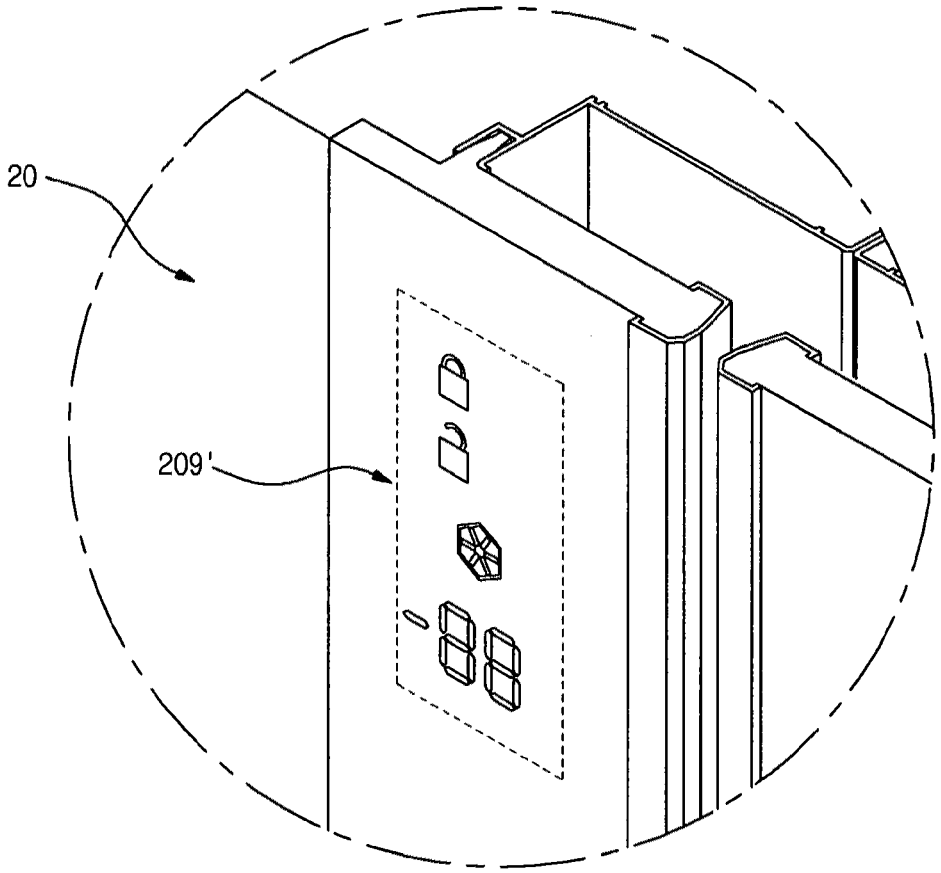
FIG. 16 is a partially-enlarged perspective view illustrating a mounting state of a transparent display unit applied to a refrigerator in accordance with another embodiment of the present invention.

Although this embodiment describes that the display unit 209 is installed at the inside of the first door side frame 201, the position of the display unit 209 is not limited thereto. That is, as shown in FIG. 16, a display unit 209' to display various data may be formed on the handle 210*a* and 210*b* made of a transparent material through a specific method, such as patterning.

Further, although this embodiment describes that the handle 210*a* and 210*b* is made of the transparent material, the material for the handle 210*a* and the 210*b* is not limited thereto. That is, the handle 210*a* and 210*b* may be made of an opaque material, as needed.

Figure 17:
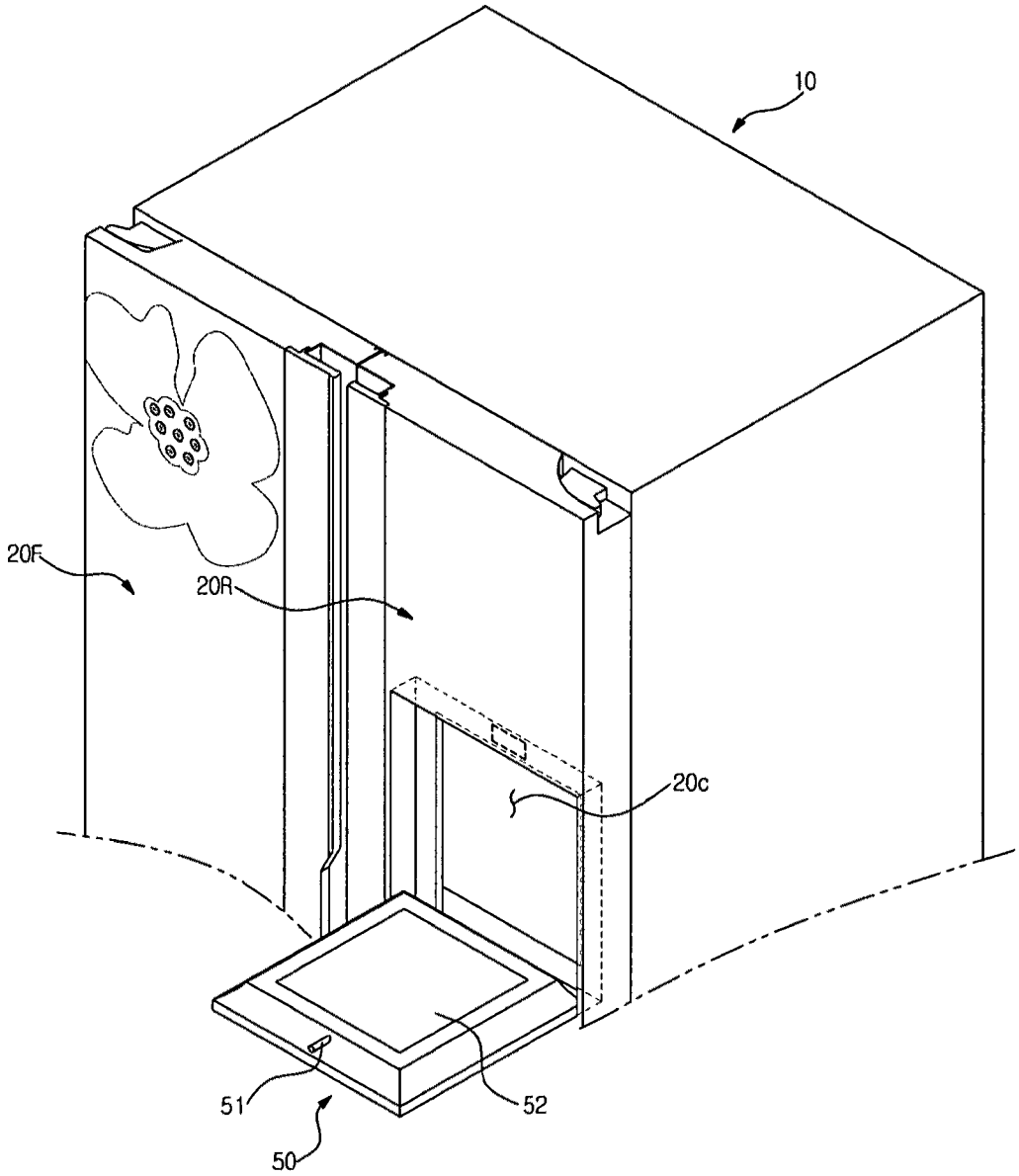
FIG. 17 is a perspective view of a sub-door applied to a refrigerator in accordance with one embodiment of the present invention.

Further, an opening 20*c* through which articles are taken out of the refrigerating chamber 111R without opening the refrigerating chamber door 20R, as shown in FIG. 17, is provided on the refrigerating chamber door 20R, and a sub-door 50 to open and close the opening 20*c* is installed at the opening 20*c*. The lower end of the sub-door 50 is rotatably installed at a part of the main body 10 adjacent to the opening 20*c*, and is rotated to open and close the opening 20*c*. Although this embodiment describes that the sub-door 50 is provided on the refrigerating chamber door 20R, the sub-door 50 may be provided on the freezing chamber door 20F.

In order to maintain the closed state of the opening 20*c* by the sub-door 50, a locking member 51 is provided on the sub-door 50, and a locking device 60 to selectively lock the locking member 51 is provided on the door 20. The locking device 60 locks the locking member 51 provided on the sub-door 50 or releases the locking of the locking member 51, and thus locks the sub-door 50 or releases the locking of the sub-door 50, thereby maintaining the closed state of the opening 20*c* by the sub-door 50 or allowing the sub-door 50 to be opened from the opening 20*c*.

The lower end of the sub-door 50 is hinged to the main body 10, and is vertically rotated so as to open and close the opening 20*c*. A sub-door support part 20*d* protruded toward the inside of the opening 20*c* to support the rear surface of the sub-door 50 is provided on the door 20. Here, the opening 20*c* includes a first opening part 20*c*-1 formed in front of the sub-door support part 20*d* to receive the sub-door 50 therein and a second opening part 20*c*-2 formed by the sub-door support part 20*d*, and the rear surface of the sub-door 50 has a wider area than the second opening part 20*c*-2 such that the edge of the rear surface of the sub-door 50 is supported by the sub-door support part 20*d*.

Further, in this embodiment, a cooling plate 52 made of metal is disposed on the rear surface of the sub-door 50. The cooling plate 52 is cooled by cool air transmitted from the refrigerating chamber 111R when the opening 20*c* is closed by the sub-door 50, and delays raise in temperature of an article placed on the cooling plate 52 provided on the rear surface of the sub-door 50 when the opening 20*c* is opened and the article is placed on the cooling plate 52.

The locking member 51 is protruded upward from the upper portion of the rear surface of the sub-door 50, and the locking device 60 is installed at a region of the door 20 adjacent to the upper portion of the first opening part 20*c*-1 so as to correspond to the locking member 51.

Figure 25:
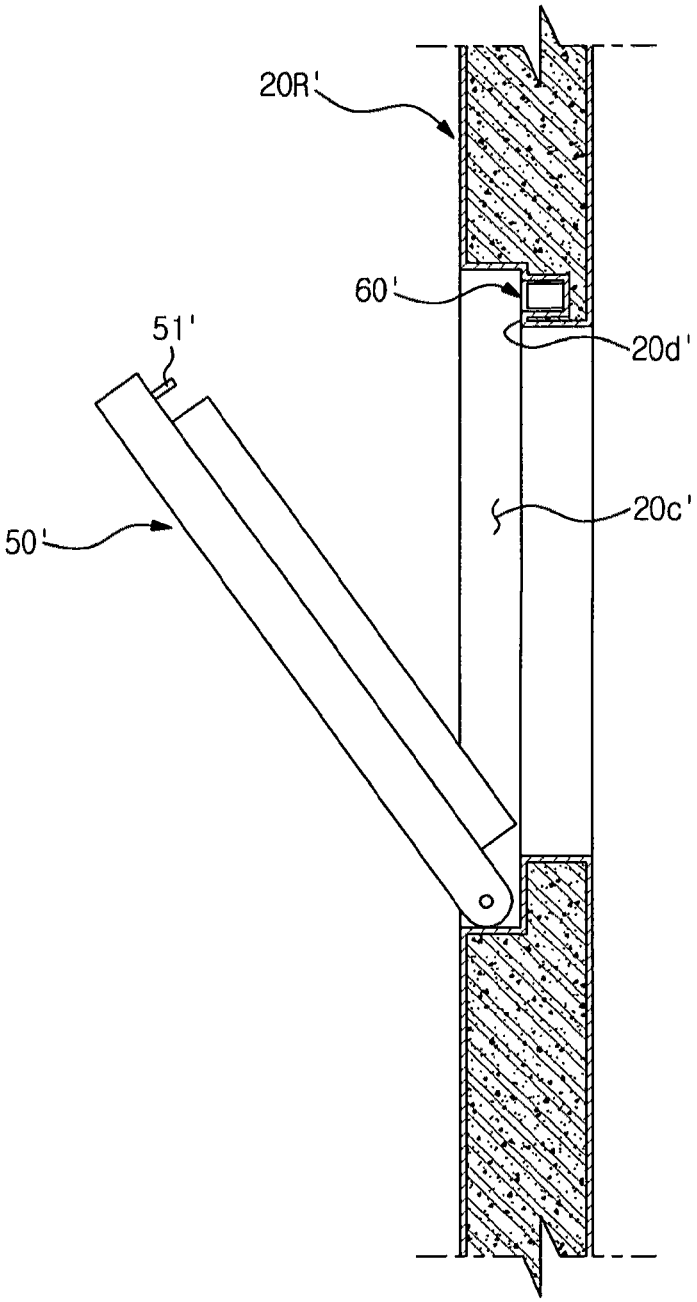
FIG. 25 is a longitudinal-sectional view illustrating a mounting state of a sub-door and a locking device applied to the conventional refrigerator.

As shown in FIG. 25, a conventional locking device 60' is installed at a sub-door support part 20*d'*. If the locking device 60' is installed at the sub-door support part 20*d'*, the sub-door support part 20*d'* requires a space to install the locking device 60', and thus the width of the sub-door support part 20*d'* needs to be greater than the height of the locking device 60'. When the width of the sub-door support part 20*d'* is increased, the area of the opening 20*c'* is inevitably reduced. Further, the conventional locking device 60' includes a rotary hook (not shown) vertically rotated and locked with a locking member 51', and in order to vertically rotate the rotary hook, the locking device 60' has a designated thickness or more in the vertical direction and such a thickness of the locking device 60' increases the width of the sub-door support part 20*d'*.

Figure 18:
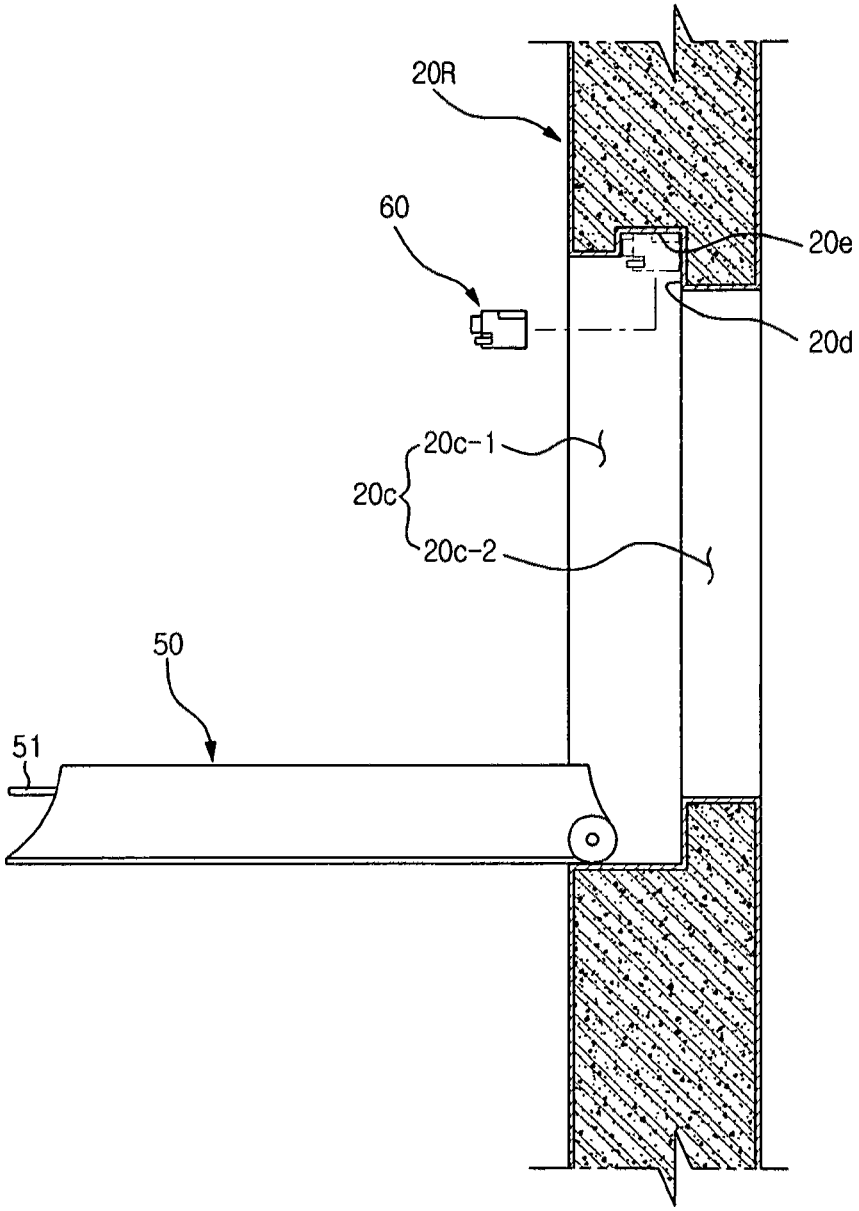
FIG. 18 is a longitudinal-sectional view illustrating a mounting state of the sub-door and a locking device applied to the refrigerator in accordance with the embodiment of the present invention.

Therefore, in this embodiment, as shown in FIG. 18, at least a part of the locking device 60 is embedded in a region of the door 20 adjacent to the upper portion of the first opening parts 20*c*-1, and the sub-door support part 20*d* is protruded toward the inside of the opening 20*c* from a region of the door 20 at the rear of the locking device 60.

In order to embed the part of the locking device in the region of the door 20 adjacent to the upper portion of the opening 20*c*, a locking device mount recess 20*e*, which is depressed upward, is formed on the region of the door 20 adjacent to the upper portion of the first opening part 20*c*-1. The locking device mount recess 20*e* has a smaller depth than the thickness of the locking device 60 in the vertical direction, and thus a part of the locking device 60 is installed within the locking device mount recess 20*e* and the remaining part of the locking device 60 is protruded toward the inside of the first opening part 20*c*-1. Fixing parts 61*c* through which fastening members, such as screws, pass are provided at both sides of a locking case 61, and the locking case 61 is fixed to the locking device mount recess 20*e* through the fixing parts 61*c*.

If at least the part of the locking device 60 is embedded in the region of the door 20 adjacent to the upper portion of the first opening part 20*c*-1 in this manner, the width of the sub-door support part 20*d* is reduced in direct proportion to the depth of the embedded part of the locking device 60, thereby increasing the size of the second opening part 20*c*-2.

Further, the locking member 51 is formed in a rod shape, and is protruded upward from the upper portion of the inner surface of the sub-door 50. Here, the front end of the locking member 51 is protruded to a height corresponding to the upper end of the sub-door 50.

Figure 19:
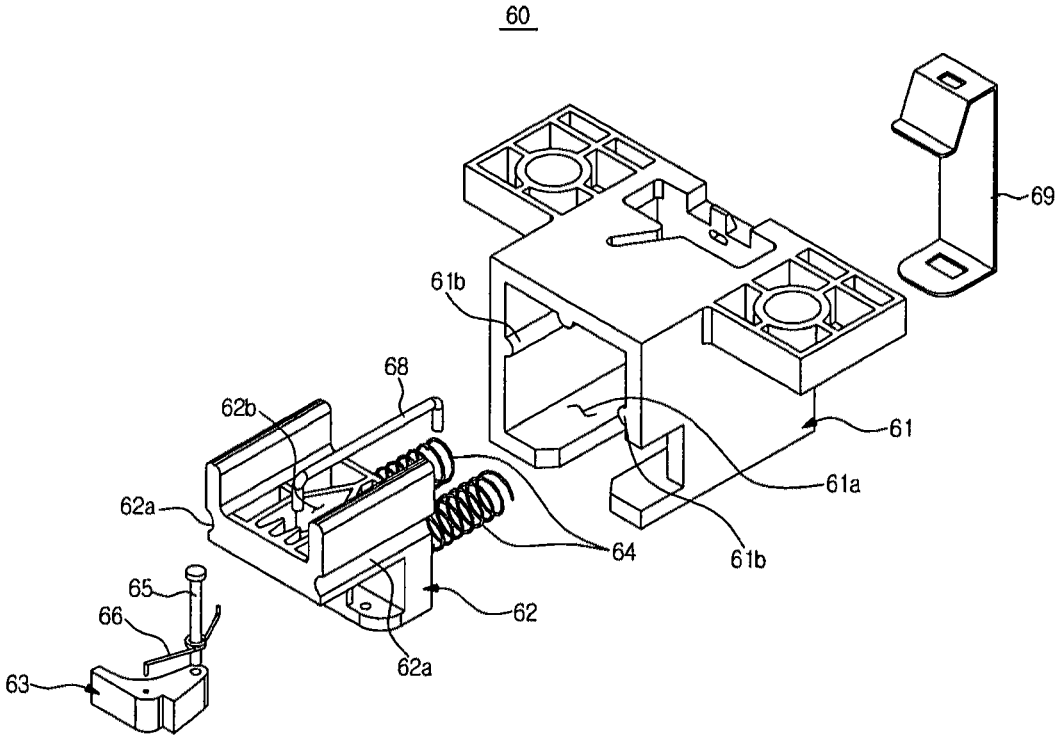
FIG. 19 is an exploded perspective view of the locking device applied to the refrigerator in accordance with the embodiment of the present invention.

The locking device 60, as shown in FIG. 19, includes the locking case 61, a sliding member 62 installed in the locking case 61 so as to be movable in the forward and backward directions, and a rotary hook 63 rotated in the rightward and leftward directions according to the position of the sliding member 62 and selectively locked with the locking member 51.

If the front end of the above-described locking member 51 formed in the rod shape is protruded to the height corresponding to the upper end of the sub-door 50 and the rotary hook 63 of the locking device 60 is rotated in the rightward and leftward directions and locked with the locking member 51, locking of the locking device 60 by the locking member 51 may be stably achieved although the locking device 60 is embedded in the region of the door 20 adjacent to the upper portion of the first opening part 20*c*-1.

A guide part 61*a* in which the sliding member 62 is movably installed is provided on the locking case 61 in the forward and backward directions, first rail parts 61*b* along which the sliding member 62 is movably installed are protruded and formed at both sides of the guide part 61*a*, and second rail parts 62*a* corresponding to the first rail parts 61*b* are depressed and formed at both sides of the sliding member 62. A pair of first elastic members 64 consisting of coil springs to elastically support the sliding member 62 so as to protrude the sliding member 62 from the locking case 61 is disposed within the guide part 61*a*.

The rotary hook 63 is rotatably installed on the sliding member 62 through a hinge shaft 65, and a second elastic member 66 consisting of a torsion spring to elastically support the rotary hook 63 so as to rotate the rotary hook 63 in one direction is installed on the hinge shaft 65.

The locking device 60 further includes a guide member 68 to maintain a state in which the sliding member 62 is received within the guide part 61*a* or a state in which a designated position of the sliding member 62 is protruded from the guide part 61*a*.

The guide member 68 restricts movement of the sliding member 62 while interacting with the sliding member 62. For this purpose, a cam hole 62*b* is provided on the upper surface of the sliding member 62, and the guide member 68 is formed in an approximately inverse U shape such that one end of the guide member 68 is movably installed in the cam hole 62*a* and the other end of the guide member 68 is rotatably installed on the locking case 61. A support plate 69 to restrict upward movement of the guide member 68 is installed on the locking case 61.

Figure 20:
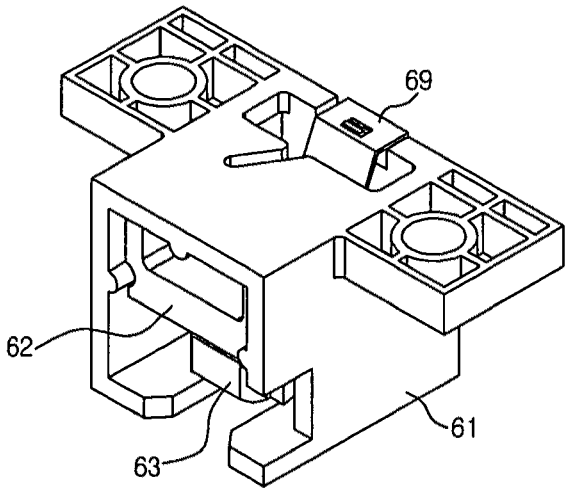
FIGS. 20 and 21 are perspective views illustrating an operating state of the locking device applied to the refrigerator in accordance with the embodiment of the present invention.
Figure 21:
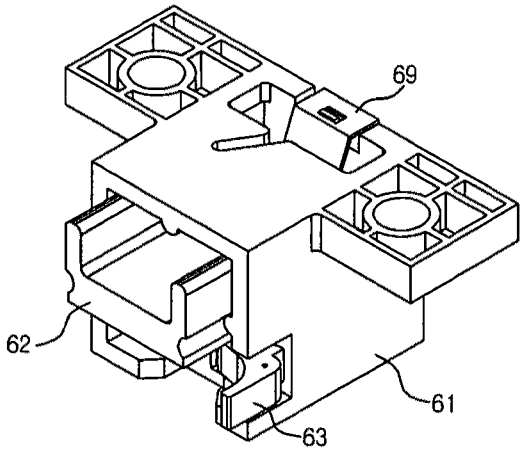

Therefore, as shown in FIG. 20, in a state in which the sliding member 62 is received in the guide part 61*a* of the locking case 61, the rotary hook 63 is supported by the side surfaces of the guide part 61*a* and thus the locking member 51 is locked with the rotary hook 63. Further, as shown in FIG. 21, when at least a designated part of the sliding member 62 is protruded from the guide part 61*a* of the locking case 61, the rotary hook 63 is separated from the guide part 61*a* and is then rotated in one direction by elastically restoring force of the second elastic member 66 of the rotary hook 63, and thereby locking of the locking member 51 by the locking device 60 is released.

Figure 22:
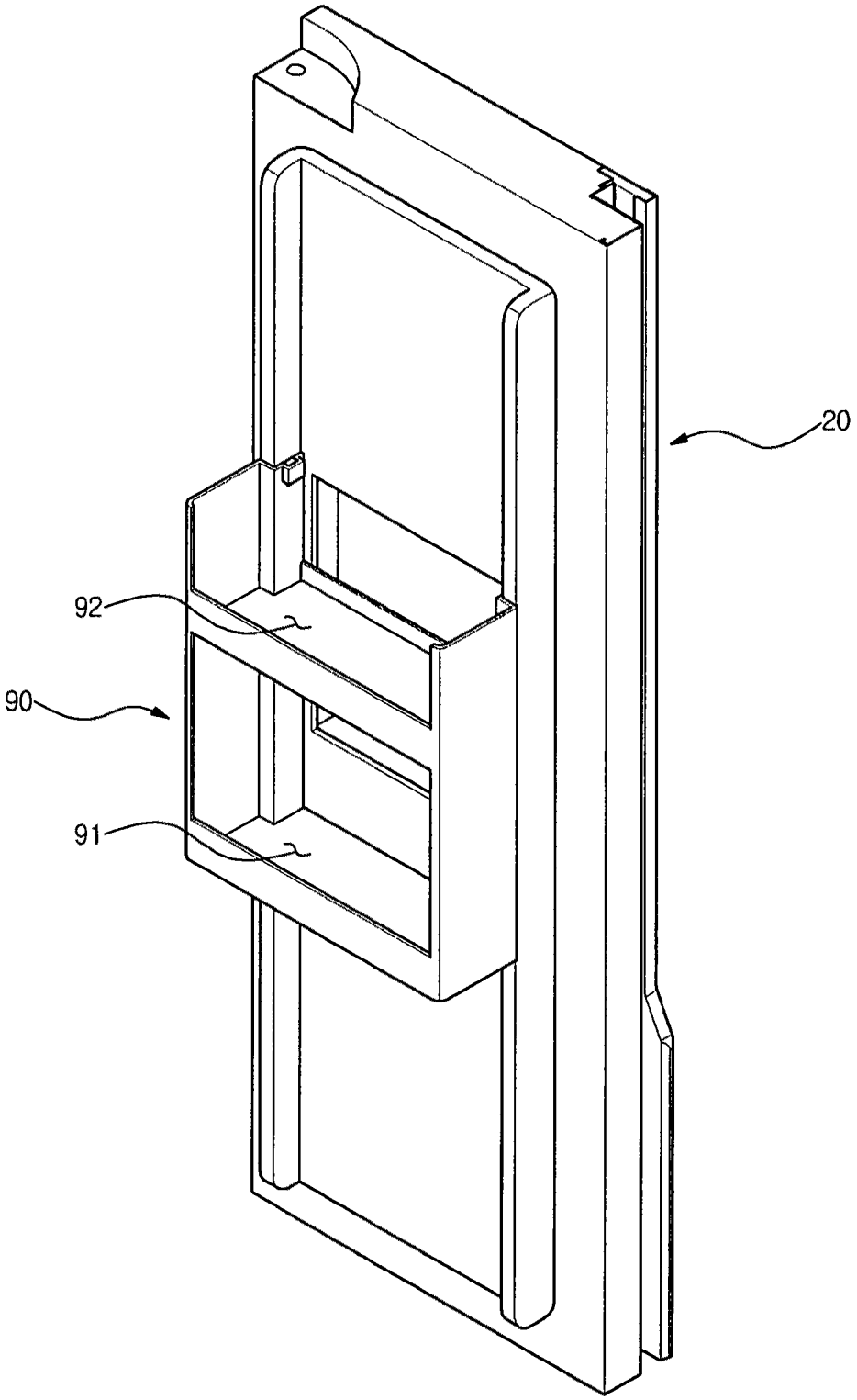
FIG. 22 is a perspective view of a door shelf applied to the refrigerator in accordance with the embodiment of the present invention.

Further, as shown in FIG. 22, a door shelf 90 to contain articles to be taken out through the opening 20*c* is disposed on the rear surface of the door 20. In this embodiment, as described above, the width of the sub-door support part 20*d* is decreased, and thus the size of the second opening part 20*c*-2 is increased. Therefore, in order to more efficiently use the opening 20*c*, the door shelf 90 is formed in a two-stage structure in which a first storage part 91 provided at the lower portion of the door shelf 90 and a second storage part 92 provided above the first storage part 91 are integrally formed. In this embodiment, the first storage part 91 has a greater height than the second storage part 92 so as to store articles having relatively high height, such as plastic bottles, and the second storage part 92 has a smaller height than the first storage part 91 so as to store articles having relatively low height, such as canned beverages.

As is apparent from the above description, in a refrigerator in accordance with one embodiment of the present invention, rear ends of upper hinge modules are mounted in main body hinge receipt parts of a main body and front ends of the upper hinge modules are mounted in door hinge receipt parts of doors, and thus the height of the doors and the height of the main body are substantially equal to each other, thereby allowing the main body provided with the storage chambers having a wider volume to be used in the refrigerator having a designated height.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a main body provided with storage chambers;

doors to open and close the storage chambers;

upper hinge modules to enable one side of the upper end of each door to be rotatably installed on the main body;

lower hinge modules to enable one side of the lower end of each door to be rotatably installed on the main body;

main body hinge receipt parts forming lower surfaces depressed on the upper surface of the main body to embed a portion of each of the upper hinge modules in the upper surface of the main body; and door hinge receipt parts depressed on the rear surfaces of the doors to receive the remaining portion of each of the upper hinge modules, wherein the main body includes an outer case, and an inner case disposed at the inside of the outer case and forming the storage chambers;

wherein the outer case includes a main frame and upper frames installed at the upper end of the main frame, the main body hinge receipt parts being provided on the upper frames;

wherein one of the upper frames includes an upper reinforcing frame disposed at a lower side of the one upper frame and the upper reinforcing frame forms the main body hinge receipt parts together with the one of the upper frame; and wherein each of the upper hinge modules include an upper hinge bracket provided with a front end protruded forward from the main body and an upper hinge rotatably supporting the upper end of each door, a fixing bracket disposed between the upper hinge bracket and the upper reinforcing frame and inside of each main body hinge receipt part to fix the rear end of the upper hinge bracket, and a fixing lever rotatably installed on the fixing bracket to selectively apply pressure to the upper hinge bracket to be supported by the fixing bracket according to a rotation angle of the fixing lever, wherein the upper reinforcing frame includes a pair of bent parts provided at both ends thereof so as to correspond to the lower surfaces of the main body hinge receipt parts of the upper frames, and wherein a through hole is formed through the lower surface of each main body hinge receipt part, the through hole being dimensioned to pass the fixing bracket therethrough such that the fixing bracket is fixed directly to each of the pair of bent parts of the upper reinforcing frame through the through hole.

2. The refrigerator according to claim 1, wherein the upper frames include a first upper frame disposed at the front portion of the upper surface of the main frame and provided with the main body hinge receipt parts.

3. The refrigerator according to claim 2, wherein the upper frames further include a second upper frame disposed at the rear of the first upper frame in parallel with the first upper frame so as to form the upper surface of the outer case together with the first upper frame.

4. The refrigerator according to claim 3, wherein the first upper frame is made of resin.

5. The refrigerator according to claim 4, wherein:

the first upper frame includes the upper reinforcing frame made of metal; and both sides of the upper reinforcing frame are recessed so as to correspond to the main body hinge receipt parts.

6. The refrigerator according to claim 1, wherein the fixing bracket is fixed directly to the upper reinforcing frame.

7. A refrigerator comprising:

a main body divided into a freezing chamber and a refrigerating chamber;

a freezing chamber door and a refrigerating chamber door to open and close the freezing chamber and the refrigerating chamber, respectively; and a pair of upper hinge modules to enable one side of the upper end of each of the freezing chamber door and the refrigerating chamber door to be rotatably installed on the main body, wherein:

a pair of main body hinge receipt parts forming lower surfaces depressed at both sides of the upper surface of the main body to embed rear ends of the pair of upper hinge modules in the upper surface of the main body; and a pair of door hinge receipt parts is depressed on the rear surfaces of the freezing chamber door and the refrigerating chamber door to receive front ends of the pair of upper hinge modules, wherein the main body includes an outer case, and an inner case disposed at the inside of the outer case and forming the freezing chamber and the refrigerating chamber;

wherein the outer case includes a main frame, a first upper frame disposed at the front portion of the upper end of the main frame and provided with the pair of main body hinge receipt parts, and a second upper frame disposed at the rear portion of the upper end of the main frame, wherein the first upper frame includes an upper reinforcing frame disposed at a lower side of the first upper frame and the upper reinforcing frame forms the main body hinge receipt parts together with the first upper frame, and wherein each of the upper hinge modules include an upper hinge bracket provided with a front end protruded forward from the main body and an upper hinge rotatably supporting the upper end of each door, a fixing bracket disposed between the upper hinge bracket and the upper reinforcing frame and inside of each main body hinge receipt part to fix the rear end of the upper hinge bracket, and a fixing lever rotatably installed on the fixing bracket to selectively apply pressure to the upper hinge bracket to be supported by the fixing bracket according to a rotation angle of the fixing lever, wherein the upper reinforcing frame includes a pair of bent parts provided at both ends thereof so as to correspond to the lower surfaces of the main body hinge receipt parts of the upper frame, and wherein a through hole is formed through the lower surface of each main body hinge receipt part, the through hole being dimensioned to pass the fixing bracket therethrough such that the fixing bracket is fixed directly to each of the pair of bent parts of the upper reinforcing frame through the through hole.

8. The refrigerator according to claim 7, further comprising a pair of lower hinge modules to enable one side of the lower end of each of the freezing chamber door and the refrigerating chamber door to be rotatably installed on the main body, wherein a portion of each lower hinge module is installed on the lower surface of the main body and the remaining portion of each lower hinge module is protruded forward from the main body and installed under each of the freezing chamber door and the refrigerating chamber door.

9. The refrigerator according to claim 8, wherein a lower reinforcing frame is installed at a portion of the main frame where the lower hinge modules are installed to reinforce the portion of the main frame so as to stably install the lower hinge modules on the lower surface of the main frame.

10. The refrigerator according to claim 8, wherein each lower hinge module includes a lower hinge bracket provided with a portion installed on the lower surface of the main body and the remaining portion protruded forward from the main body and extended under each of the freezing chamber door and the refrigerating chamber door, a leg installed on the lower portion of the lower hinge bracket to allow the lower hinge bracket and the main body provided with the lower hinge bracket to rest on the ground, a lower hinge disposed at the front end of the lower hinge bracket to rotatably support one side of the lower end of each of the freezing chamber door and the refrigerating chamber door, and an elevating device vertically moving the lower hinge to move each of the freezing chamber door and the refrigerating chamber door in the vertical direction.

11. The refrigerator according to claim 10, wherein a lower hinge recess into which the lower hinge disposed at the front end of the lower hinge bracket is inserted is formed at the lower end of one side of each of the freezing chamber door and the refrigerating chamber door, and a stopper is disposed facing the front end of the lower hinge bracket to limit a rotation angle of each of the freezing chamber door and the refrigerating chamber door.

12. The refrigerator according to claim 7, wherein the fixing bracket is fixed directly to the upper reinforcing frame.

* * * * *